US010923862B2

(12) United States Patent
Chen

(10) Patent No.: US 10,923,862 B2
(45) Date of Patent: Feb. 16, 2021

(54) CONNECTOR

(71) Applicant: Ying Hao Technology CO., LTD., New Taipei (TW)

(72) Inventor: Chih-Jung Chen, New Taipei (TW)

(73) Assignee: YING HAO TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/246,158

(22) Filed: Jan. 11, 2019

(65) Prior Publication Data

US 2019/0252829 A1 Aug. 15, 2019

(30) Foreign Application Priority Data

Feb. 14, 2018 (TW) ..... 107202451

(51) Int. Cl.

| | |
|---|---|
| ***H01R 24/00*** | (2011.01) |
| ***H01R 13/6585*** | (2011.01) |
| ***H01R 24/60*** | (2011.01) |
| ***H01R 13/66*** | (2006.01) |
| ***H01R 43/24*** | (2006.01) |

(52) U.S. Cl.

CPC ..... *H01R 13/6585* (2013.01); *H01R 13/665* (2013.01); *H01R 24/60* (2013.01); *H01R 43/24* (2013.01)

(58) Field of Classification Search

CPC ... H01R 13/6585; H01R 24/60; H01R 13/665
USPC .... 439/607.01, 660, 607.05, 607.07, 607.09, 439/607.11, 676
See application file for complete search history.

(56) References Cited

U.S. PATENT DOCUMENTS

| | | | | |
|---|---|---|---|---|
| 7,651,379 | B1 * | 1/2010 | Wu | H01R 12/62 439/108 |
| 8,894,451 | B2 * | 11/2014 | Shiratori | H01R 13/6471 439/660 |
| 9,401,573 | B1 * | 7/2016 | Fernandez | H01R 13/6593 |
| 10,411,413 | B2 * | 9/2019 | Feng | H01R 13/6594 |
| 2015/0194772 | A1 * | 7/2015 | Little | H01R 13/6582 439/357 |
| 2016/0372850 | A1 * | 12/2016 | Tsai | H01R 13/6471 |
| 2017/0201053 | A1 * | 7/2017 | Guo | H01R 12/75 |
| 2017/0222373 | A1 * | 8/2017 | Tsai | H01R 13/6585 |
| 2017/0271820 | A1 * | 9/2017 | Ho | H01R 13/6594 |
| 2018/0166830 | A1 * | 6/2018 | Feng | H01R 13/6581 |
| 2018/0337488 | A1 * | 11/2018 | Zhang | H01R 12/716 |
| 2019/0020154 | A1 * | 1/2019 | Wan | H01R 13/6582 |
| 2019/0148889 | A1 * | 5/2019 | Little | H01R 13/6587 439/607.05 |
| 2019/0173235 | A1 * | 6/2019 | Feng | H01R 13/6594 |

(Continued)

*Primary Examiner* — Abdullah A Riyami
*Assistant Examiner* — Nelson R. Burgos-Guntin
(74) *Attorney, Agent, or Firm* — Hamre, Schumann, Mueller & Larson, P.C.

(57) ABSTRACT

A connector includes a shell configured to protect the connector and to be plugged into a connecting port slot, a plurality of terminals electrically connected to the connecting port slot, a connecting portion connected to an electronic device, a circuit board, and a cover. The circuit board includes a first contact portion electrically connected to the plurality of terminals, and a second contact portion, electrically connected to the connecting portion. The cover is fixed to the shell. The shell is arranged between the circuit board and the shell to fix the circuit board in the shell.

14 Claims, 19 Drawing Sheets

(56) References Cited

U.S. PATENT DOCUMENTS

2019/0199038 A1* 6/2019 Zhou ..... H01R 13/6587
2019/0252829 A1* 8/2019 Chen ..... H01R 43/24

* cited by examiner

CONNECTOR

CROSS REFERENCE

This application is claims the benefit and priority of Taiwanese Application No. 107202451, filed on Feb. 14, 2018. The entire disclosure of the above application is incorporated herein by reference.

BACKGROUND

1. Field of the Disclosure

The present disclosure relates to a connector, and more particularly, to a connector with low production cost.

2. Description of the Related Art

Generally, a connector is designed in such a manner that the terminal is shaped as a bar and fixed to a circuit board correspondingly. However, there are a variety of electronic devices, and the specifications for connection between electronic devices are also different. Therefore, it is necessary to design a variety of terminal arrangements for a variety of specifications of connectors. It is also necessary to design a proper circuit board for a corresponding terminal. However, it causes trouble in production and costs a lot as well.

SUMMARY

In view of this, the purpose of this disclosure is to provide a connector according to various specifications and types of requirements by designing different terminals of a connector under the same size of the circuit board so that the shapes and arrangements of the terminals fit different slots of diverse devices. In addition, the connector proposed by the disclosure improves the grounding effect of the ground layer of the circuit board, thereby improving the efficiency of noise isolation. Ultraviolet (UV) glue is arranged on the circuit board to isolate the circuit board from the terminal and fix the terminal more stably without shaking.

According a first aspect of the present disclosure, a connector comprises a shell configured to protect the connector and to be plugged into a connecting port slot, a plurality of terminals electrically connected to the connecting port slot, a connecting portion connected to an electronic device, a circuit board, and a cover. The circuit board comprises a first contact portion electrically connected to the plurality of terminals, and a second contact portion, electrically connected to the connecting portion. The cover is fixed to the shell. The shell arranged between the circuit board and the shell to fix the circuit board in the shell.

According a second aspect of the present disclosure, a connector comprises a shell configured to protect the connector and to be plugged into a connecting port slot, a connecting portion, a circuit board, and a cover. One terminal of the connecting portion is connected to an electronic device, and the other terminal of the connecting portion extends to the shell and is connected to the connecting port slot. The circuit board comprises a first contact portion. The cover surrounds the circuit board and comprises an outer groove. The connecting portion penetrates the outer groove to contact the circuit board.

According to the embodiments of the present disclosure, a variety of shapes or arrangements for the connector proposed by the present disclosure satisfy users with different requirements. The connector applies to slots of different electronic devices without replacing the circuit board.

These and other features, aspects and advantages of the present disclosure will become understood with reference to the following description, appended claims and accompanying figures.

DETAILED DESCRIPTION OF THE EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

Figure 1:
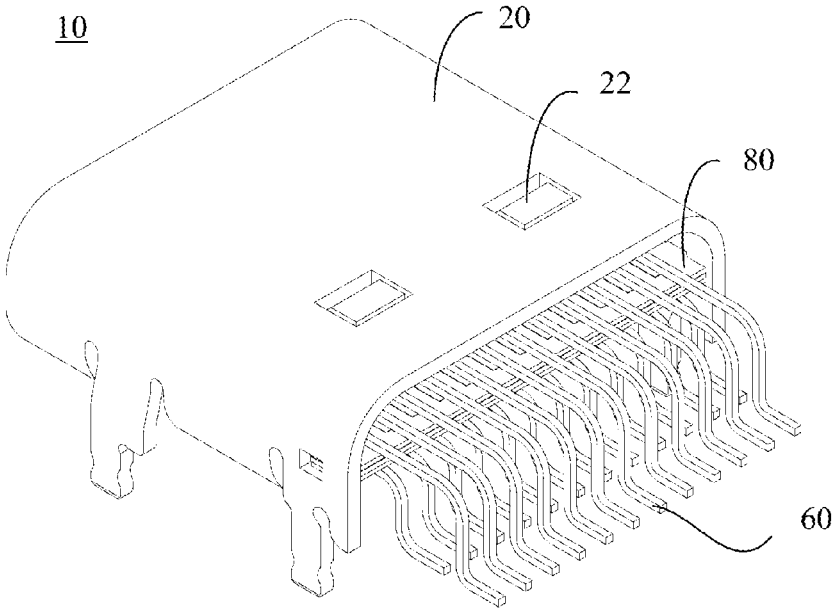
FIG. 1 illustrates a diagram of a connector according to a first embodiment of the present disclosure.

Please refer to FIG. 1 illustrating a diagram of a connector 10 according to a first embodiment of the present disclosure. The connector 10 includes a shell 20, a cover 22, a connecting portion 60, and a circuit board 80. The shell 20 is configured to fix a slot of the connecting port of an external device. The connecting portion 60 is a connecting electronic device (not illustrated). The electronic device can be a storage device, a network device, a multimedia device, a communication terminal, a mechanical device, etc., and can be connected to an external device with the connector 10 of the present disclosure. Furthermore, the electronic device is connected to the connector 10 via the connecting portion 60 and is connected to the external device through the connector 10. In the present embodiment, the connecting portion 60 is a stripped terminal.

Figure 2:
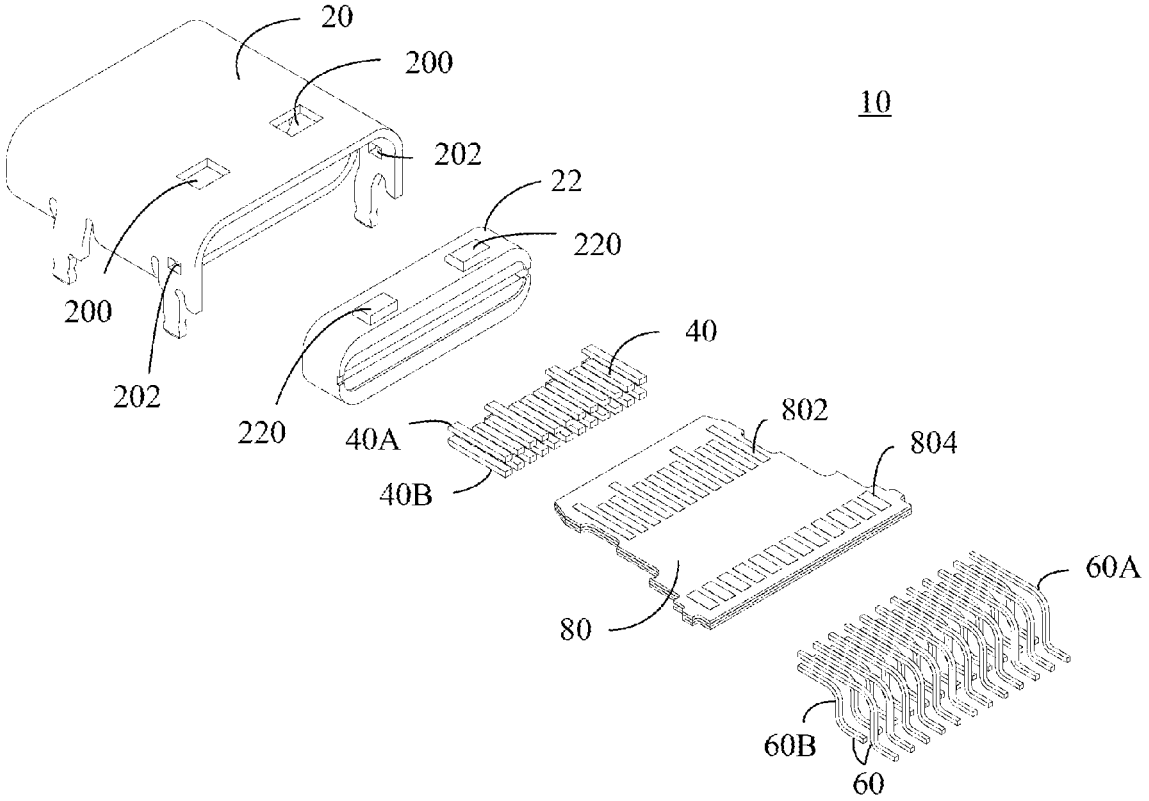
FIG. 2 is an exploded diagram of the first embodiment of the present disclosure.

FIG. 2 is an exploded diagram of the first embodiment of the present disclosure. As illustrated in FIG. 2, the connector 10 includes a plurality of terminals 40. A first contact portion 802 and a second contact portion 804 arranged on the circuit board 80. The first contact portion 802 and the second contact portion 804 are formed by a plurality of metal coatings. In more detail, the plurality of terminals 40 are divided into the first terminal 40A and the second terminal 40B of upper and lower rows, respectively. The connecting portion is also divided into a first connecting portion 60A and a second connecting portion 60B of the upper and lower rows, respectively. The first terminal 40A is electrically connected to the first contact portion 802. The shape, distribution and number of the metal coating on the first contact portion 802 corresponds to the shape, distribution and number of the first terminal 40A. The first connecting portion 60A is electrically connected to the second contact portion 804. The shape, distribution and number of the metal coating on the second contact portion 804 corresponds to the shape, distribution and number of the first connecting portion 60A.

Figure 3:
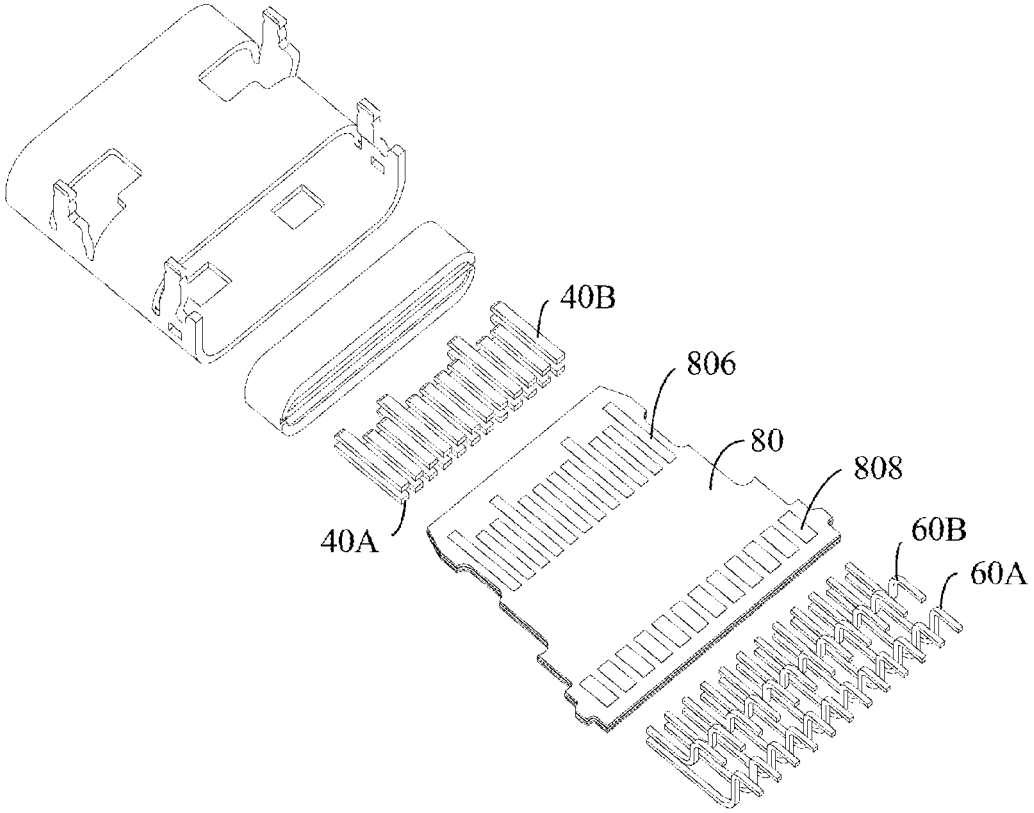
FIG. 3 is an exploded diagram of the connector but an upside down diagram of the connector as illustrated in FIG. 2.

The circuit board 80 includes two upper and lower contact portions in the present embodiment. FIG. 3 is an exploded diagram of the connector 10 but an upside down diagram of the connector 10 as illustrated in FIG. 2. The circuit board 80 also includes two contact portions on the back, that is, a third contact portion 806 and a fourth contact portion 808, respectively. The third contact portion 806 and the fourth contact portion 808 are also formed by a plurality of metal coatings. The third contact portion 806 is electrically connected to the second terminal 40B. The shape, distribution and number of the metal coating on the third contact portion 806 corresponds to the shape, distribution and number of the second terminal 40B. The fourth contact portion 808 is electrically connected to the second connecting portion 60B. The shape, distribution and number of the metal coating on the fourth contact portion 808 corresponds to the shape, distribution and number of the second connecting portion 60B.

Figure 4A:
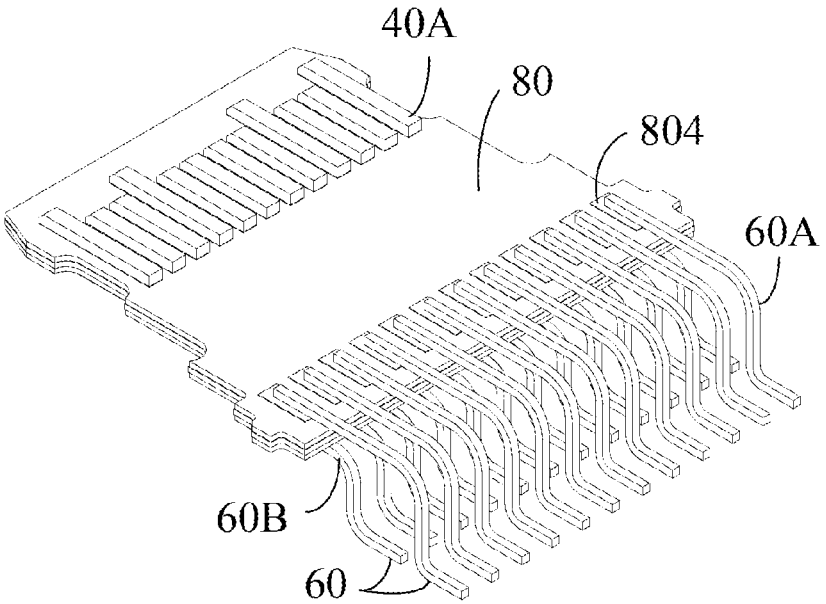
FIG. 4A is a diagram of the first terminal, the connecting portion, and the circuit board of the connector.
Figure 5:
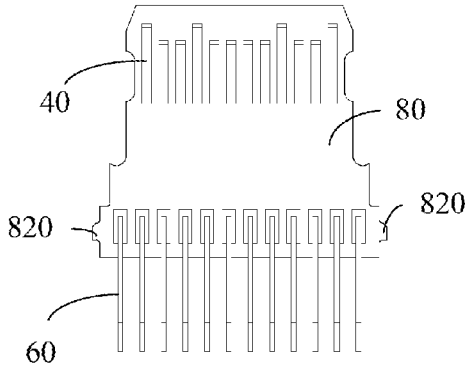
FIG. 5 is a top view of the terminal, the connecting portion, and the circuit board of the connector.
Figure 8:
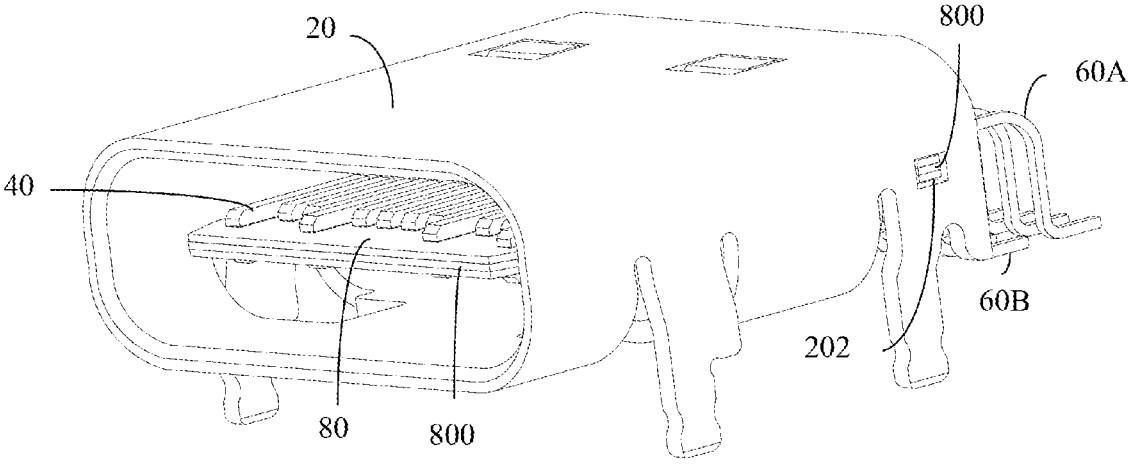
FIG. 8 is a side view of the embodiment from another angle.

FIG. 4A is a diagram of the first terminal 40A, the connecting portion 60, and the circuit board 80 of the connector 10. The first terminal 40A and the connecting portion 60 are respectively arranged on two sides of the circuit board 80. The first terminal 40A and the first connecting portion 60A are also arranged on the upper side of the circuit board 80. The second terminal 40B (the second terminal 40B cannot be illustrated from the viewing angle of FIG. 4A) and the second connecting portion 60B are arranged on the lower side of the circuit board 80. Please refer to FIG. 5 as well. FIG. 5 is a top view of the terminal 40, the connecting portion 60, and the circuit board 80 of the connector 10. The lengths of the terminals 40 are various to meet specific slot structures. The terminal 40 can be designed freely according to various slots in the present disclosure. The arrangements and distributions of the lengths of the terminals in the present embodiment are merely exemplary and are not intended to limit the disclosure. The circuit board 80 further includes two protruding latching portions 820. The latching portions 820 are configured to fix the circuit board 80 on the shell 20. The structure of the latching portion 820 and the shell 20 will be described in detail when FIG. 8 is introduced.

Figure 4B:
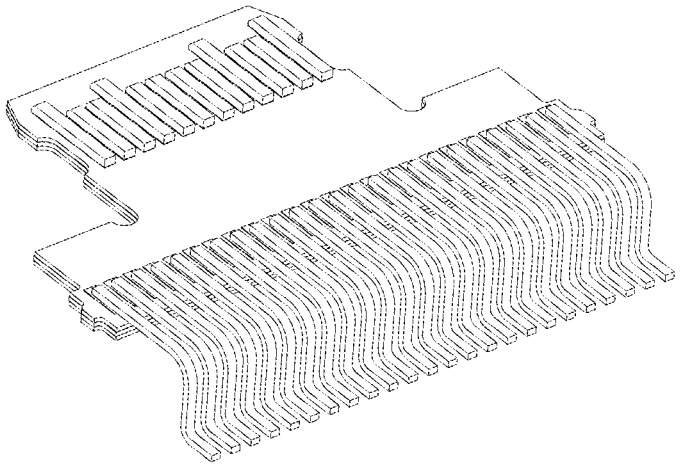
FIG. 4B illustrates a diagram of the first connector, the first connecting portion, and the circuit board according to the present embodiment of the present disclosure.
Figure 4C:
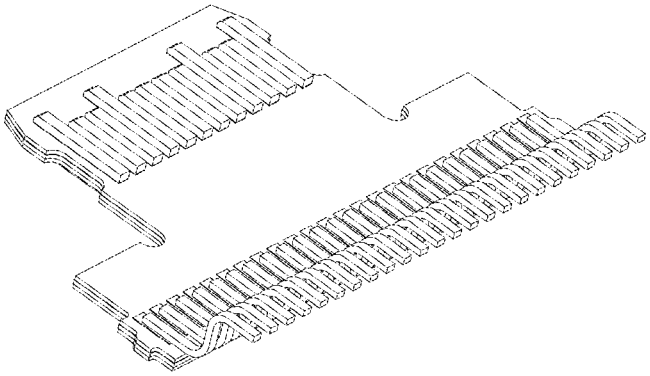
FIG. 4C illustrates a diagram of the second connector, the second connecting portion, and the circuit board according to the present embodiment of the present disclosure.

FIG. 4B illustrates a diagram of the first connector 40A, the first connecting portion 60A, and the circuit board 80 according to the present embodiment of the present disclosure. FIG. 4C illustrates a diagram of the second connector 40B, the second connecting portion 60B, and the circuit board 80 according to the present embodiment of the present disclosure. Unlike the embodiment illustrated in FIG. 4A, the first connecting portion 60A welded to the second contact portion 804 arranged on the upper side of the circuit board 80 is necessary without the second connecting portion 60B in the embodiment as illustrated in FIG. 4B. In the embodiment illustrated in FIG. 4C, the second connecting portion 60B welded to the fourth contact portion 808 on the lower side of the circuit board 80 is adopted without the first connecting portion 60A.

Figure 6:
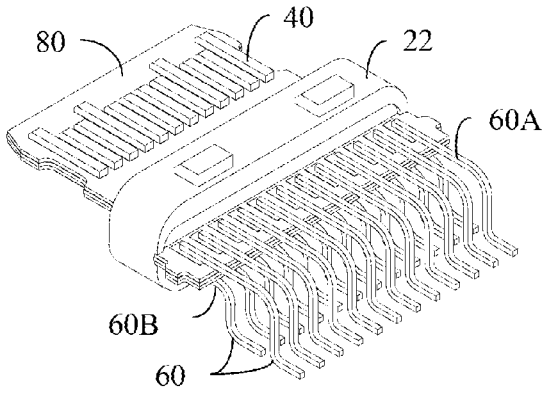
FIG. 6 illustrates a diagram of the cover for the connector, the terminal, the connecting portion, and the circuit board according to the embodiment of the present disclosure.

Please refer to FIG. 6 illustrating a diagram of the cover 22 for the connector, the terminal 40, the connecting portion 60, and the circuit board 80 according to the embodiment of the present disclosure, that is, a diagram of the connector removed from the shell 20. The cover 22 is arranged between the shell 20 and the circuit board 80. The cover 22 includes two protrusions 220. The protrusions 220 conform to the two holes 200 in the shell 20. The protrusions 220 can be caught on the holes 200. The cover 22 functions to fill in the space between the shell 20 and the circuit board 80 to make the circuit board 80 fixed into the shell 20 firmly.

Figure 7:
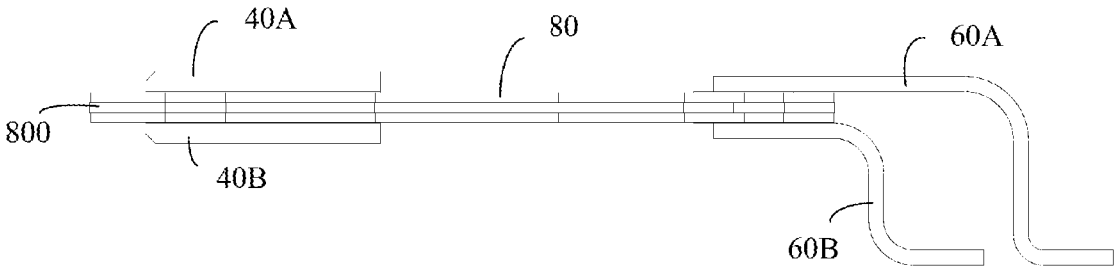
FIG. 7 is a side view of the first terminal, the second terminal, the first connecting portion, the second connecting portion, and the circuit board of the connector according to the embodiment of the present disclosure.

FIG. 7 is a side view of the first terminal 40A, the second terminal 40B, the first connecting portion 60A, the second connecting portion 60B, and the circuit board 80 of the connector according to the embodiment of the present disclosure. As illustrated in the side view, the connecting portion 60 includes the first connecting portion 60A and the second connecting portion 60B, and the first connecting portion 60A and the second connecting portion 60B are on the upper and lower rows of the connecting portion 60. The first connecting portion 60A is bent 90 degrees downward to be perpendicular to the circuit board 80, and then bent back 90 degrees to be parallel with the circuit board 80. The shape of the second connecting portion 60B is similar to the shape of the first connecting portion 60A, but the length of the connecting portion 60B is less than the length of the first connecting portion 60A. The structure of the two rows is a long upper row and a short lower row. Such a design is good to avoid shortcut due to mutual contact. In the embodiment, the structure of the connecting portion is exemplary, and the purpose is simply to avoid short circuit between the upper and lower rows. It is notified that any disconnected connecting portions of the upper and lower rows are within the scope of the present disclosure.

FIG. 7 further illustrates a ground layer 800 in the middle of the circuit board 80. In general, the circuit board 80 includes two or more than two printed circuit boards (PCBs). The ground layer 800 is a shielding layer of the circuit board 80 and configured to isolate the upper and lower layers from signal interference of the circuit. Please refer to FIG. 8 as well. FIG. 8 is a side view of the embodiment from another angle. The shell 20 of the connector proposed by the present disclosure further includes two lateral holes 202. The lateral holes 202 are arranged at two sides of the shell 20, respectively. The locking portions 820 of the circuit board 80 (as illustrated in FIG. 5) are arranged at positions corresponding to the lateral holes 202. So the locking portions 820 are caught in the lateral holes 202 to make the circuit board 80 fixed onto the shell 20. The ground layer 800 on the circuit board 80 can also be electrically connected to the shell 20. In this way, the ground layer 800 provides better shielding to prevent the upper and lower layers from signal interference. Further, conductive glue can apply to the area where the locking portion 820 and the lateral hole 202 are connected to ensure that the locking portion 820 and the lateral hole 202 are electrically connected and that the friction and shaking between the locking portion 820 and the lateral hole 202 is well reduced.

Figure 9:
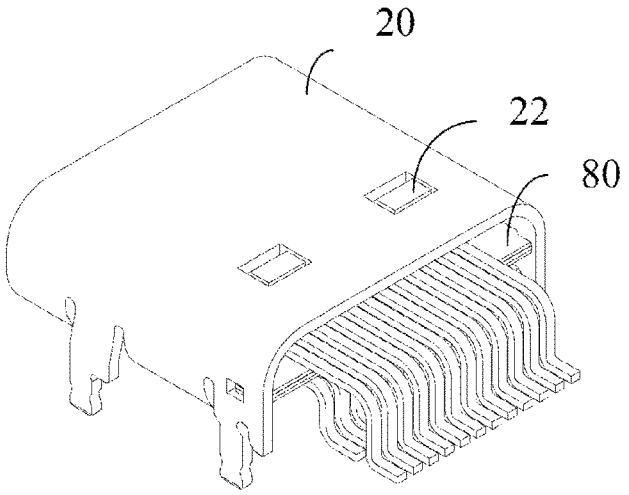
FIG. 9 illustrates a diagram of a connector according to a second embodiment of the present disclosure.
Figure 10:
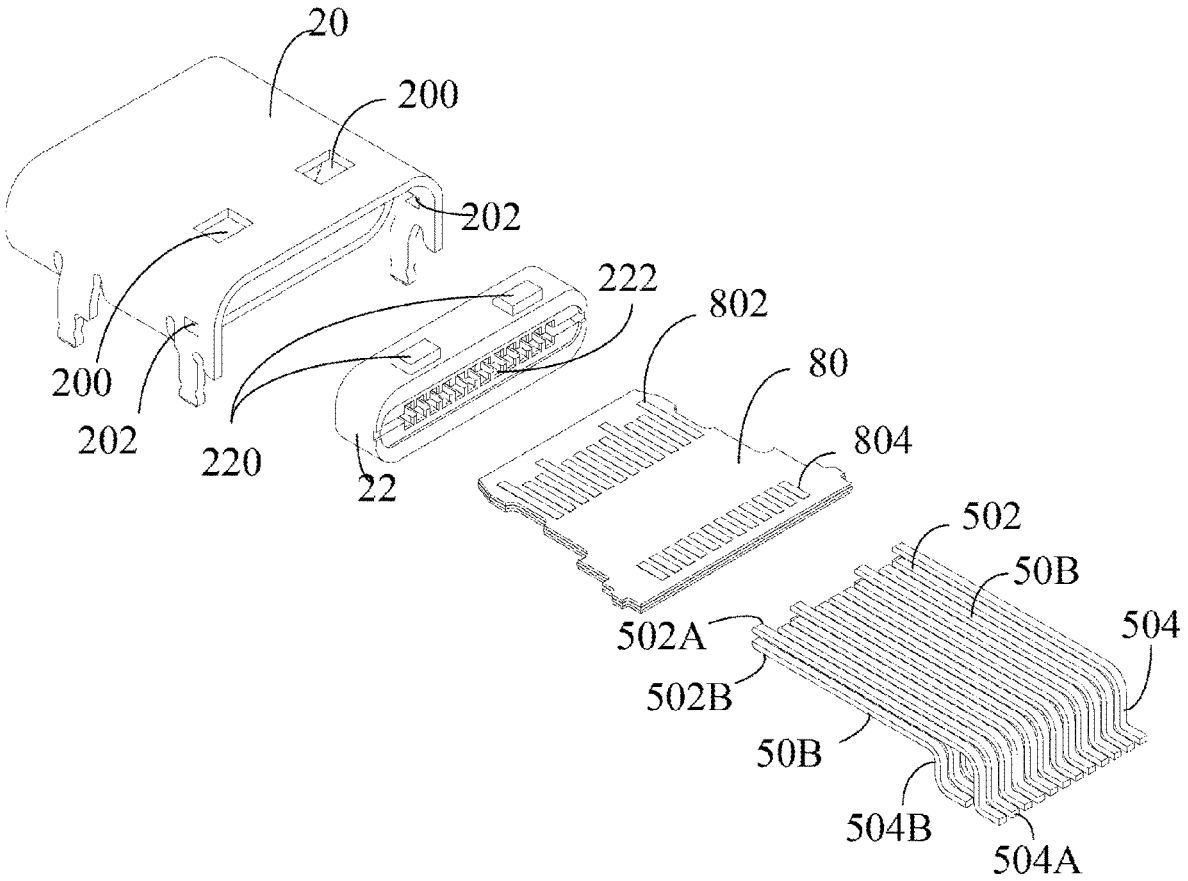
FIG. 10 is an exploded diagram of the second embodiment of the present disclosure.

Please refer to FIG. 9 illustrating a diagram of a connector according to a second embodiment of the present disclosure. The connector proposed by the second embodiment is similar to the connector introduced by the first embodiment in appearance so refer to FIG. 10 as well. FIG. 10 is an exploded diagram of the second embodiment of the present disclosure. As illustrated in FIG. 10, the connector 10 includes a shell 20, a cover 22, and a circuit board 80 as well. Different from the first embodiment, a plurality of terminal connecting portions 50 are a terminal 40 and a connecting portion 60 integrally formed in the present disclosure. The terminal connecting portion 50 includes the first terminal 502 of the terminal connecting portion 50 and the second terminal 504 of the terminal connecting portion 50. The function of the first terminal 502 of the terminal connecting portion 50 is similar to the function of the terminal 40 introduced in the first embodiment. The function of the second terminal 504 of the terminal connecting portion 50 is similar to the function of the connecting portion 60. The first terminal 502 of the terminal connecting portion 50 is connected to the external device. The second terminal 504 of the terminal connecting portion 50 is connected to the external device. In addition, in the structure in which the terminal connecting portion 50 is integrally formed, the cover 22 includes a plurality of inner grooves 222 arranged on the upper and lower rows, which can fit the width and the number of the terminal connecting portions 50, so that the terminal connecting portion 50 can be fixed onto the inner groove 222. In the above, it does not happen that the terminal connecting portion 50 contacts with the circuit board 80 poorly due to shaking.

Please refer to FIG. 10. The circuit board 80 includes the first contact portion 802 and the second contact portion 804. The first contact portion 802 and the second contact portion 804 are formed by a plurality of metal coatings. Likewise, the terminal connecting portion 50 includes the first terminal connecting portion 50A and the second terminal connecting portion 50B. The first terminal connecting portion 50A and the second terminal connecting portion 50B are on the upper and lower rows, respectively. The first terminal connecting portion 50A includes a first terminal 502A and a second terminal 504A. The second terminal connecting portion 50B includes a first terminal 502B of the second terminal connecting portion 50B and a second terminal 504B of the second terminal connecting portion 50B. The first terminal 502A is electrically connected to the first contact portion 802. The shape, distribution and number of the metal coating on the first contact portion 802 corresponds to the shape, distribution and number of the first terminal 502A. The second terminal 504A is electrically connected to the second contact portion 804. The shape, distribution and number of the metal coating on the second contact portion 804 corresponds to the shape, distribution and number of the second terminal 504A.

Figure 11:
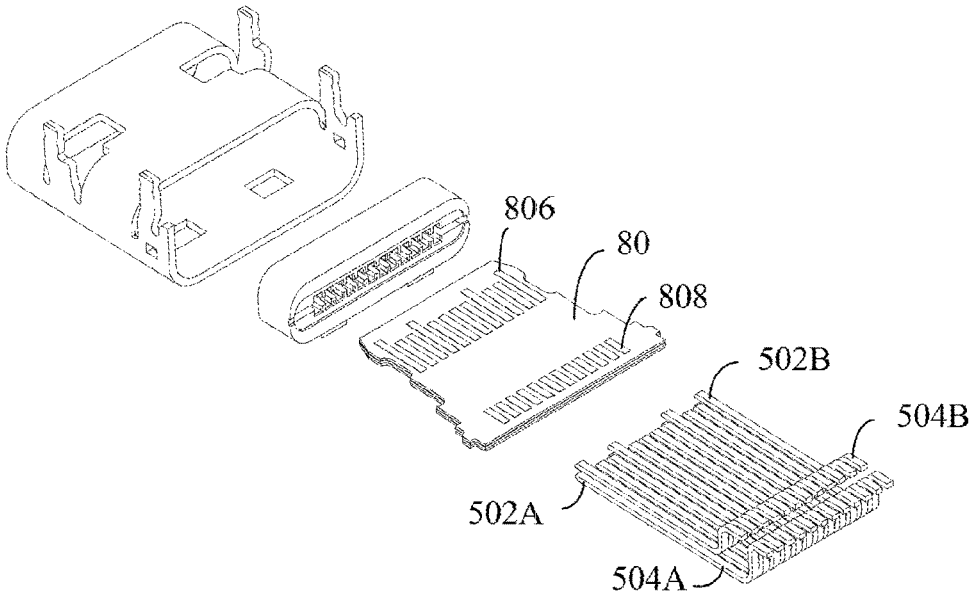
FIG. 11 is an exploded diagram of the connector but an upside down diagram of the connector as illustrated in FIG. 10.

Similarly, in the second embodiment, the circuit board 80 includes two upper and lower contact portions in the second embodiment. FIG. 11 is an exploded diagram of the connector 10 but an upside down diagram of the connector 10 as illustrated in FIG. 10. The circuit board 80 also includes two contact portions on the back, that is, a third contact portion 806 and a fourth contact portion 808, respectively. The third contact portion 806 and the fourth contact portion 808 are also formed by a plurality of metal coatings. The third contact portion 806 is electrically connected to the first terminal 502B of the second terminal connecting portion 50B. The shape, distribution and number of the metal coating on the third contact portion 806 corresponds to the shape, distribution and number of the first terminal 502B of the second terminal connecting portion 50B. The fourth contact portion 808 is electrically connected to the second connecting portion 60B. The shape, distribution and number of the metal coating on the fourth contact portion 808 corresponds to the shape, distribution and number of the second terminal 504B of the second terminal connecting portion 50B.

Figure 12:
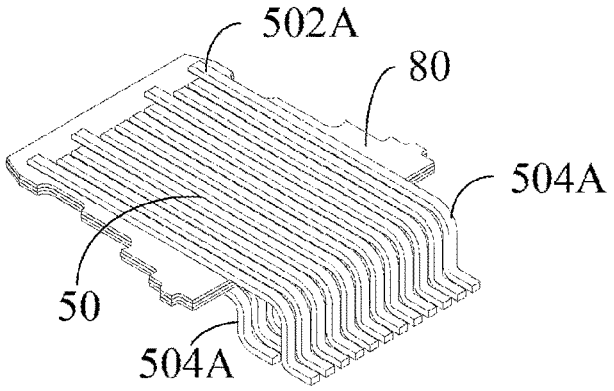
FIG. 12 is a diagram of the terminal connecting portion and the circuit board.
Figure 13:
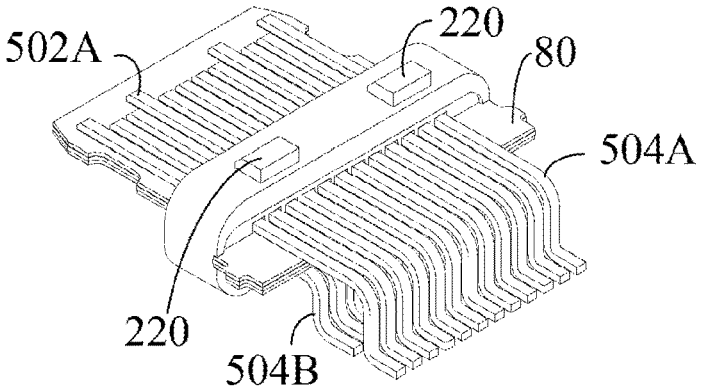
FIG. 13 is a diagram of the terminal connecting portion and the circuit board illustrated in FIG. 12 with the cover attached thereto.

FIG. 12 is a diagram of the terminal connecting portion 50 and the circuit board 80. The terminal connecting portion 50 is simultaneously connected to the first contact portion 802 and the second contact portion 804 on the circuit board 80. FIG. 13 is a diagram of the terminal connecting portion 50 and the circuit board 80 illustrated in FIG. 12 with the cover 22 attached thereto, that is, a diagram of the connector 10 removed of the shell 20 in second embodiment. The cover 22 also includes two protrusions 220. The protrusions 220 conform to the two holes 200 in the shell 20. The protrusions 220 can be caught on the holes 200. The cover 22 functions to fill in the space between the shell 20 and the circuit board 80 to make the circuit board 80 fixed into the shell 20 firmly. Different from the first embodiment, the terminal 40 and the connecting portion 60 are integrally formed to make the cover 22 with an inner groove 222 in the present disclosure. Therefore, the terminal connecting portion 50 can penetrates the cover 22 and be electrically connected to the first contact portion 802 and the second contact portions 804 simultaneously.

Figure 14:
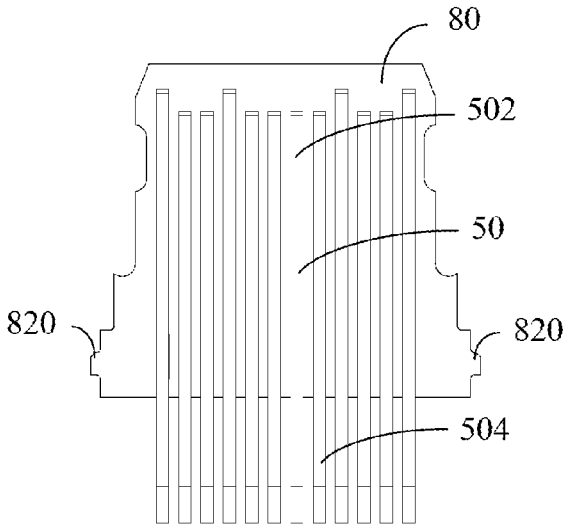
FIG. 14 is a top view of the terminal connecting portion and the circuit board of the connector.

FIG. 14 is a top view of the terminal connecting portion 50 and the circuit board 80 of the connector 10. As FIG. 14 illustrates, the first terminal 502 of the terminal connecting portion and the second terminal 504 of the terminal connecting portion are both long and straight, that is, the width, distribution and number of the first terminal 502 of the terminal connecting portion is the same as the width, distribution and number of the second terminal 504 of the terminal connecting portion, which means that the width and number of the first contact portion 802 is the same as the width and number of the second contact portion 804 on the circuit board 80. The length of the terminal 40 is various to meet specific slot structures. The first terminal 502 of the terminal connecting portion can be designed freely according to various slots in the present disclosure. The arrangements and distributions of the length of the terminal in the present embodiment are merely exemplary and are not intended to limit the disclosure.

Figure 15:
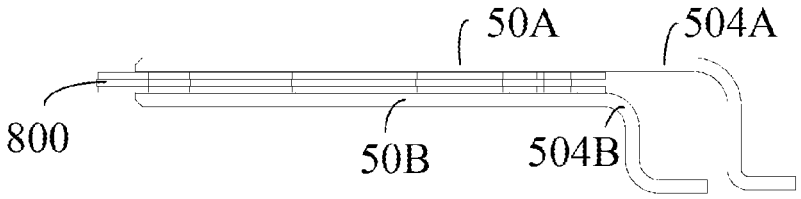
FIG. 15 is a side view of the connecting portion of the terminal and the circuit board according to the embodiment of the present disclosure.
Figure 16:
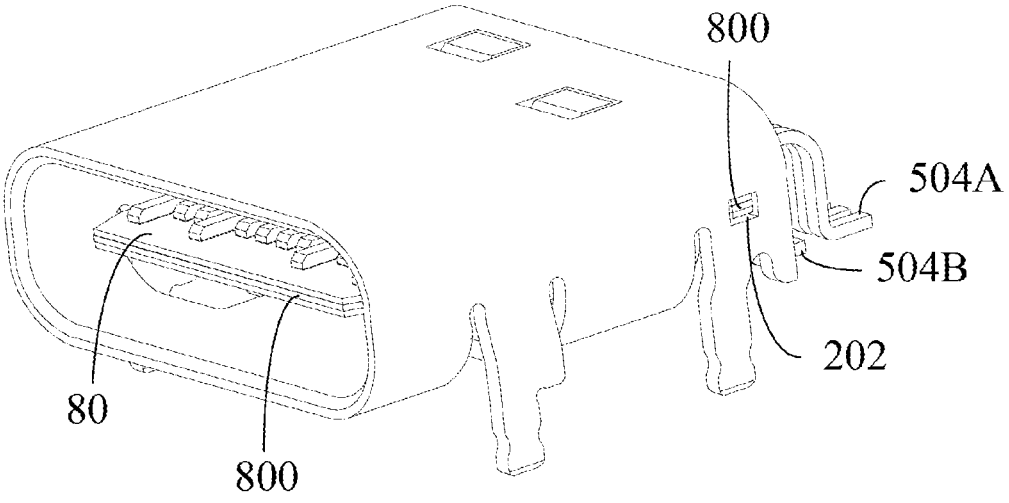
FIG. 16 is a side view of the embodiment from another angle.

FIG. 15 is a side view of the connecting portion 50 of the terminal and the circuit board 80 according to the embodiment of the present disclosure. As illustrated in the side view, the connecting portion 50 includes upper and lower rows of connecting portions 50A and 50B. The second connecting portion 504A is bent 90 degrees downward to be perpendicular to the circuit board 80, and then bent back 90 degrees to be parallel with the circuit board 80. The shape of the second terminal 504B of the second terminal connecting portion 50B is similar to the shape of the second connecting portion 504A, but the length of the second terminal 504B of the second terminal connecting portion 50B is less than the length of the second connecting portion 504A. The structure of the two rows is a long upper row and a short lower row. Such a design is good to avoid shortcut due to mutual contact. In the present embodiment, the structure of the connecting portion is exemplary, and the purpose is simply to avoid short circuit between the upper and lower rows. It is notified that any disconnected connecting portions of the upper and lower rows are within the scope of the present disclosure. The circuit board 80 includes a ground layer 800 as well. The ground layer 800 is configured to isolate the upper and lower layers from signal interference between the upper and lower layers of the circuit. Meanwhile, the circuit board 80 further includes two protrusive locking portions 820 (as illustrated in FIG. 14). The protrusive locking portions 820 are configured to fix the circuit board 80 onto the shell 20. Please refer to FIG. 16 as well. FIG. 16 is a side view of the embodiment from another angle. The shell 20 of the connector 10 proposed by the present disclosure includes two lateral holes 202. The locking portions 820 of the circuit board 80 are arranged at positions corresponding to the lateral holes 202 to make the circuit board 80 fixed onto the shell 20. The ground layer 800 on the circuit board 80 can also be electrically connected to the shell 20 to provide better shielding. Further, conductive glue can apply to the area where the locking portion 820 and the lateral hole 202 are connected to ensure that the locking portion 820 and the lateral hole 202 are electrically connected and that the friction and shaking between the locking portion 820 and the lateral hole 202 is well reduced.

Figure 17:
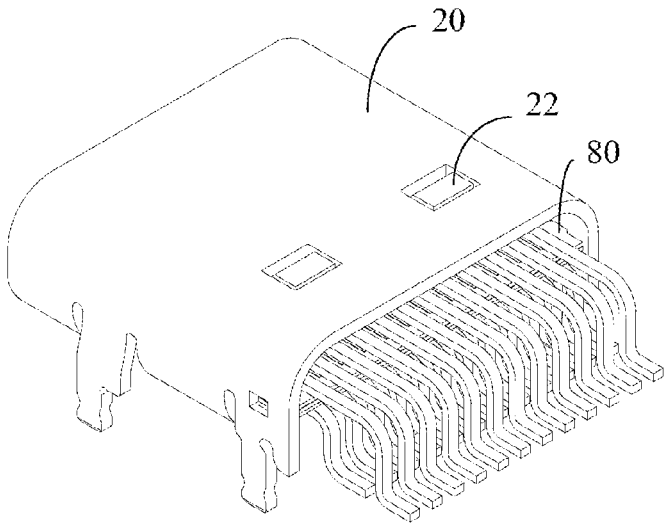
FIG. 17 illustrates a diagram of a connector according to a third embodiment of the present disclosure.
Figure 18:
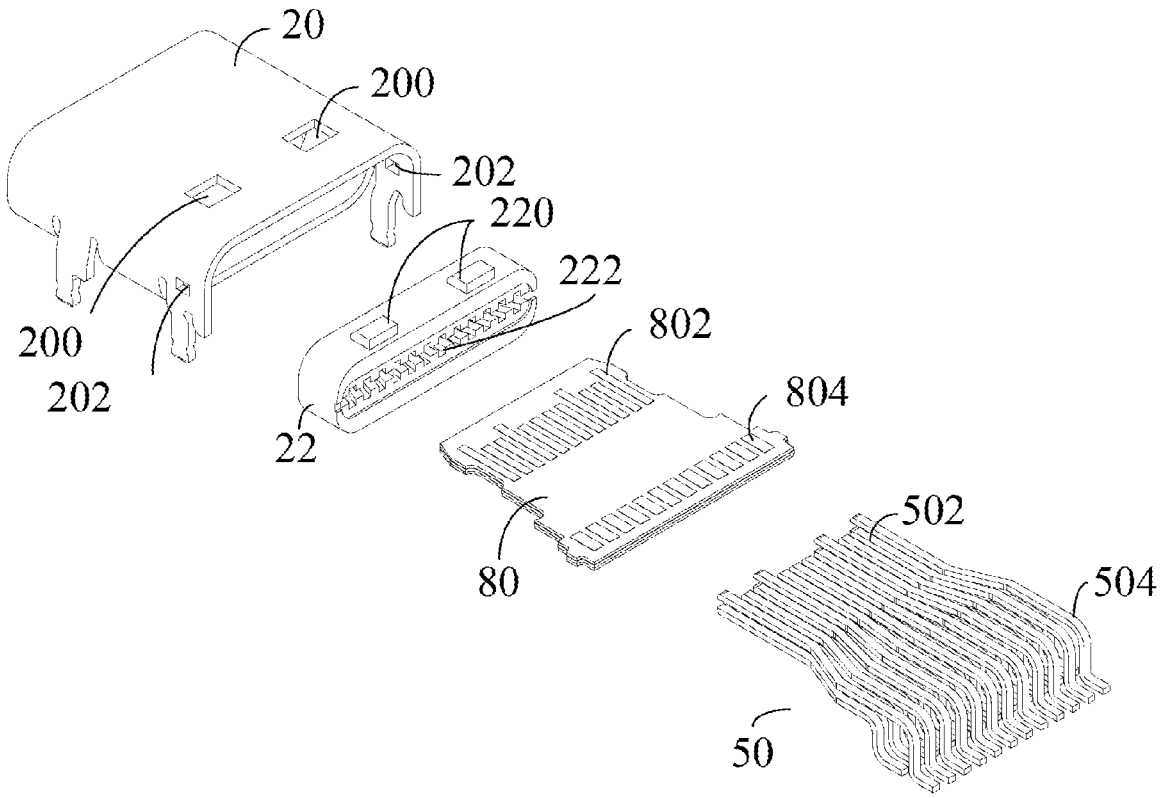
FIG. 18 is an exploded diagram of the third embodiment of the present disclosure.
Figure 19:
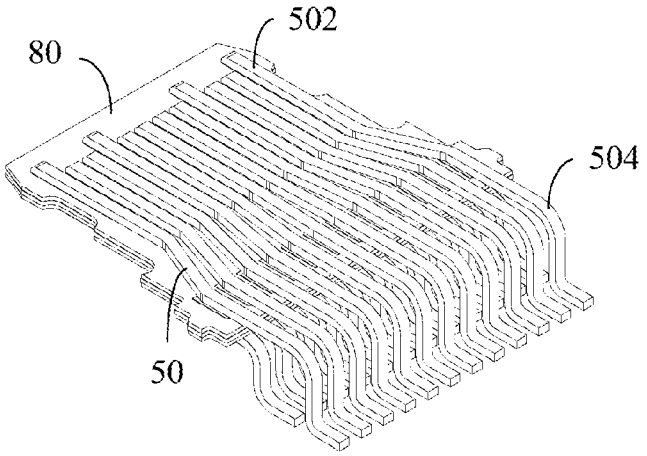
FIG. 19 illustrates a diagram of the terminal connecting portion and the circuit board in the third embodiment.
Figure 20:
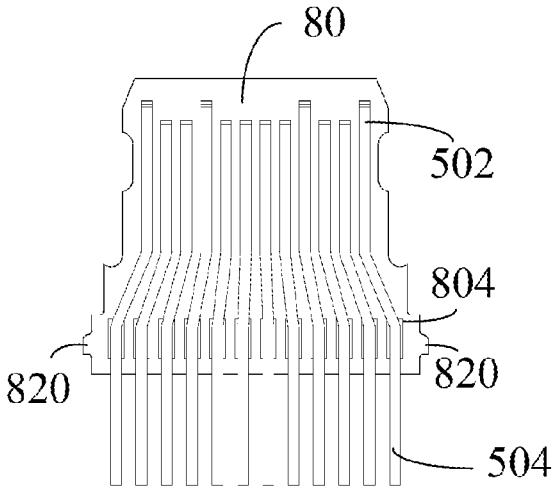
FIG. 20 illustrates a top view of the terminal connecting portion and the circuit board in the third embodiment.
Figure 21:
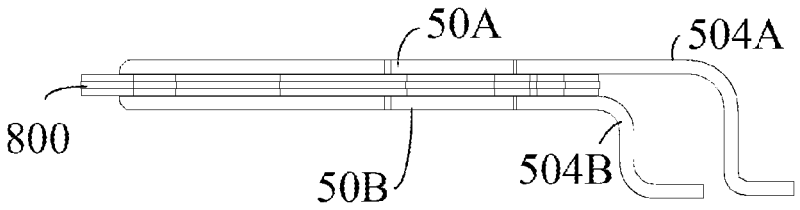
FIG. 21 is a side view of the third embodiment.

Please refer to FIG. 17 illustrating a diagram of a connector according to a third embodiment of the present disclosure. The structure of the connector proposed by the third embodiment is similar to the structure of the connector introduced by the second embodiment. The connecters both include a shell 20, a cover 22, and a circuit board 80. However, the two connectors are different in the structure of a terminal connecting portion 50. Please refer to FIG. 18 as well. FIG. 18 is an exploded diagram of the third embodiment of the present disclosure. The most obvious difference between the third embodiment and the second embodiment is the shape of the second terminal 504 of the terminal connecting portion. Please refer to FIG. 19 and FIG. 20. FIG. 19 and FIG. 20 are the diagram and the top view of the terminal connecting portion 50 and the circuit board 80 in the third embodiment, respectively. The first terminals 502 of the terminal connecting portion are arranged in parallel as well. The second terminals 504 of the terminal connecting portion fare arranged like a trapezoid roughly. The second terminals 504 of the terminal connecting portion close to the center are straight lines. The second terminals 504 of the terminal connecting portion outwards are curved to both sides, and the more outwardly the curved portion is, a greater amount of amplitude it has. In accordance with the shape of the terminal connecting portion 50, the width of the second contact portion 804 is greater than the width of the first contact portion 802 (referring to FIG. 18). The second terminals 504 of the terminal connecting portion are arranged outside the second contact portion 804. The portions where the second terminals 504 of the terminal connecting portion extend towards the outside of the circuit board 80 are arranged in parallel. FIG. 21 is a side view of the third embodiment. The second terminal 504 of the terminal connecting portion in the third embodiment is similar to the second terminal 504 of the terminal connecting portion in the second embodiment. The second terminal 504 of the terminal connecting portion is bent 90 degrees downward to be perpendicular to the circuit board 80. Afterwards, the second terminal 504 of the terminal connecting portion is bent back 90 degrees and parallel to the circuit board 80. The length of the second terminal 504B of the second terminal connecting portion is less than the length of the second terminal 504A. The third embodiment can be applied to the case that the widths of the jacks of the port slots on the external device and the electronic device mare different. The reshapes and sizes of the shell 20, the cover 22, and the circuit board 80 proposed by the second embodiment can be adopted in the third embodiment where the shape of the terminal connecting portion 50 or the metal coating on the second contact portion 804 needs to be changed. This saves the manufacturing cost of a variety of connectors.

The connecting portion 60 is a stripped terminal in the first, second, and third embodiments, In addition, the connecting portion 60 may be a cable or a flexible flat cable. Please refer to FIG. 22 for further reference.

Figure 22:
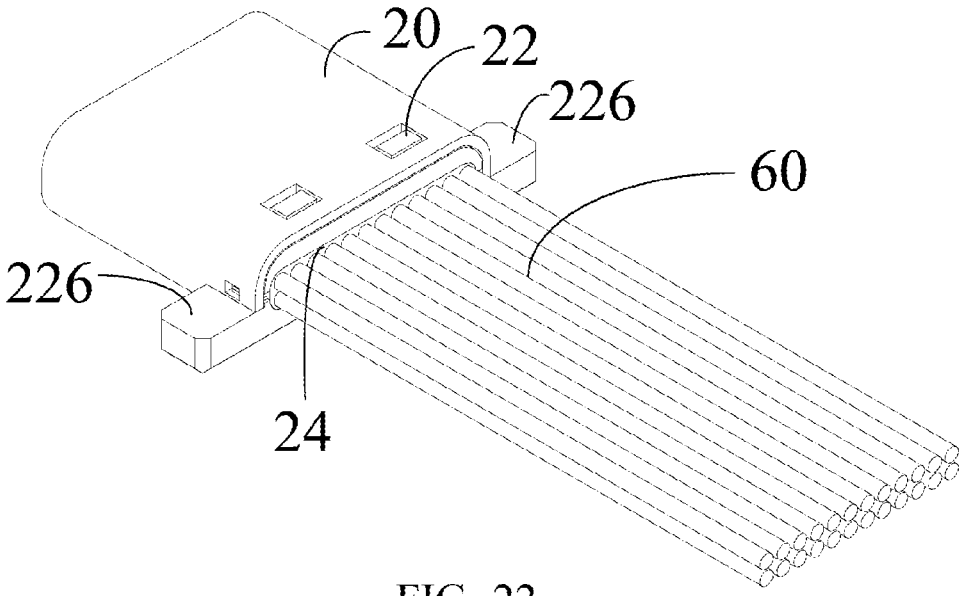
FIG. 22 is a fourth embodiment of the present disclosure.
Figure 23:
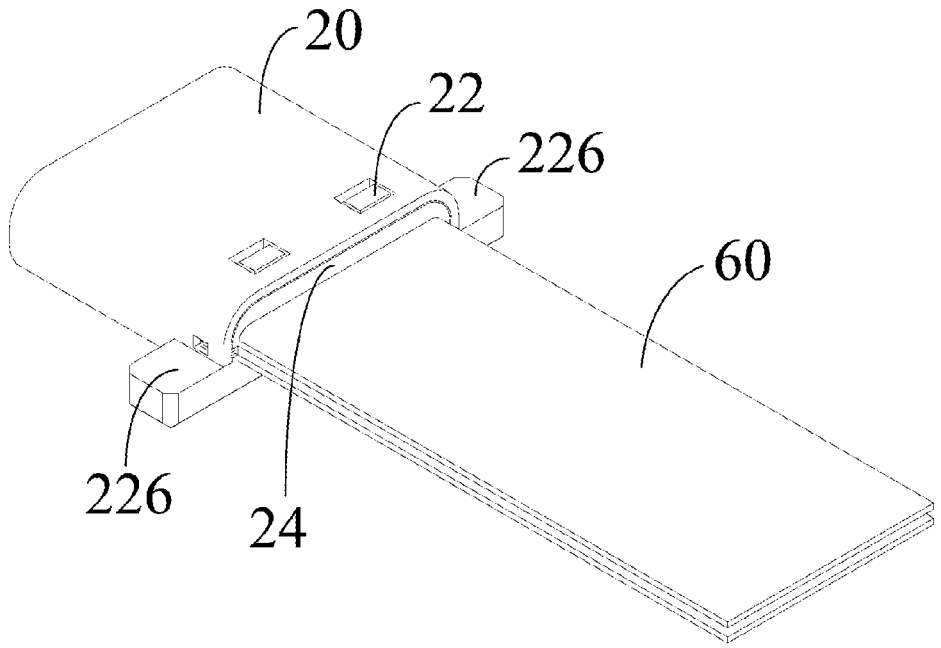
FIG. 23 illustrates a connector which comprises a flexible flat cable as the connecting portion according to the fourth embodiment of the present disclosure.

FIG. 22 is a fourth embodiment of the present disclosure. The connecting portion 60 of the fourth embodiment is a cable. The electronic device is connected to the connector 10 through the cable (that is, the connecting portion 60) and then connected to an external device through the connector 10 such that the electronic device and the external device can transmit signals to each other. The shell 20 and the circuit board 80 in the fourth embodiment are similar to the shell 20 and the circuit board 80 in the first embodiment except that a portion of the cover 22 is exposed outside the shell 20 though the cover 22 is arranged in the shell 20 in the fourth embodiment. In the first embodiment, the cover is completely arranged in the shell 20. The portion of the cover 22 exposed to the shell 20 is an outer corner 226. The cover 22 covers one terminal of the circuit board 80 near the connecting portion 60. With the outer corner 226, the user plugs or unplugs the connector 10 more conveniently. At the same time, the connecting portion 60 can also be a flexible flat cable. As illustrated in FIG. 23, the cover 22 is exposed outside the shell 20 so that the present disclosure can apply to a cable or a flexible flat cable more conveniently. Regardless of whether the connecting portion 60 is a cable or a flexible flat cable, the structure of the connecting portion 60 is always similar. The following will be explained by taking a cable as an example.

Figure 24A:
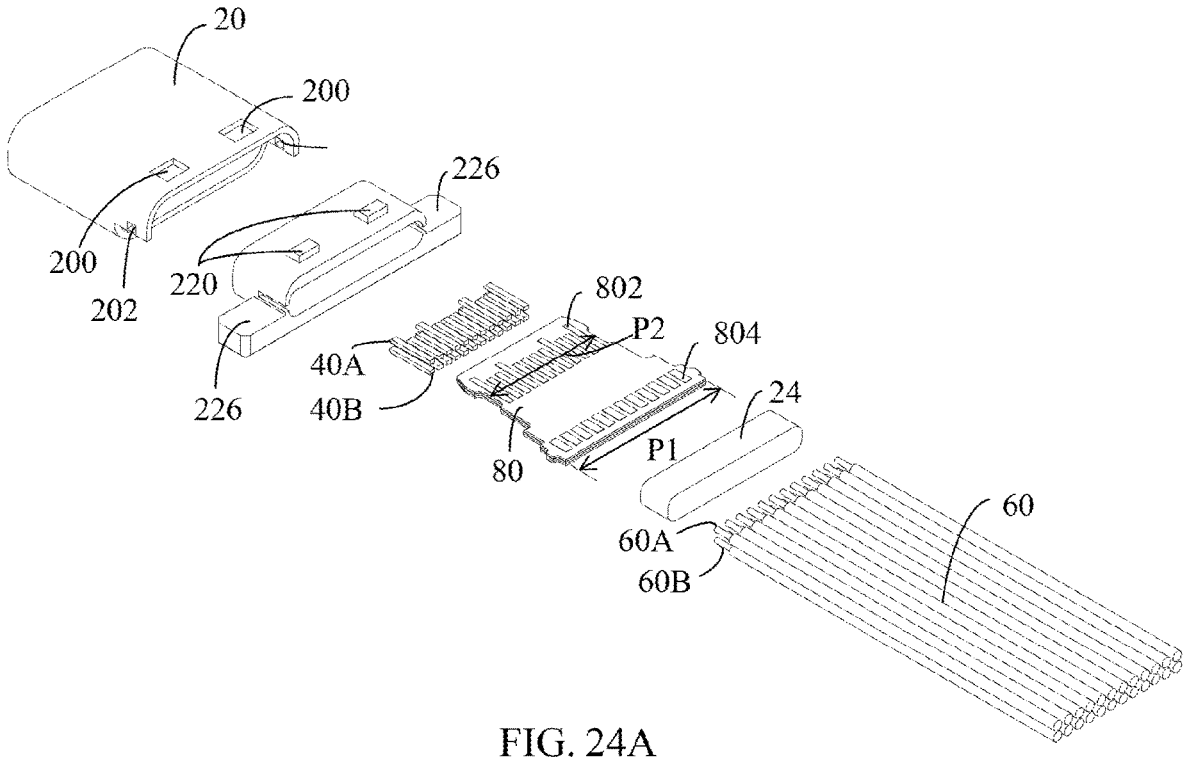
FIG. 24A is an exploded diagram of the connector according to the fourth embodiment of the present disclosure.
Figure 24B:
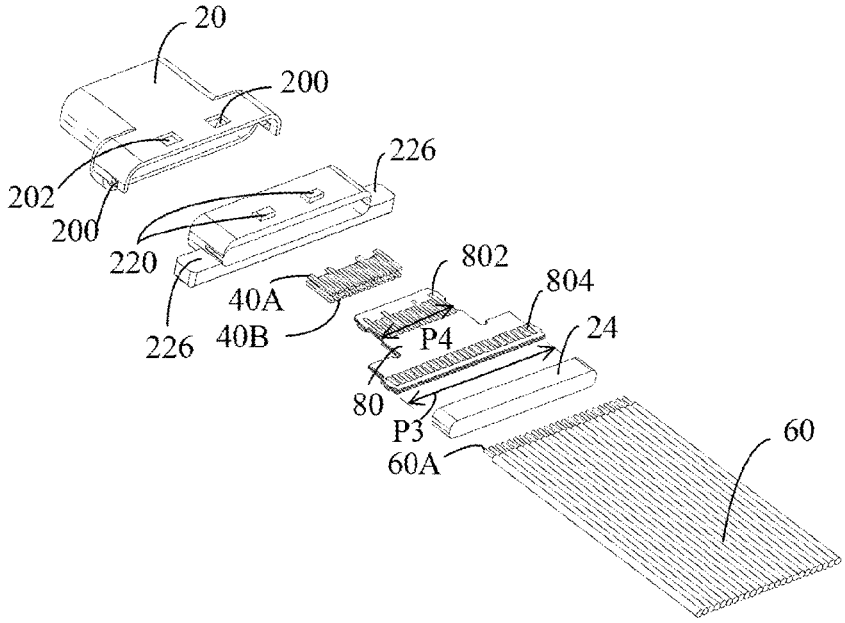
FIG. 24B is an exploded diagram of the connector according to another embodiment of the present disclosure.

FIG. 24A is an exploded diagram of the connector 10 according to the fourth embodiment of the present disclosure. The structure of the connector 10 proposed by the present disclosure is similar to the connector 10 proposed by the present disclosure. The plurality of terminals 40 include a first terminal 40A and a second terminal 40B, and the first terminal 40A and the second terminal 40B are arranged on the upper and lower rows, respectively. The connecting portion 60 includes a first connecting portion 60A and a second connecting portion 60B, and the first connecting portion 60A and the second connecting portion 60B are arranged on the upper and lower rows, respectively. Since the upper and lower sides of the circuit board 80 are respectively provided with the second contact portion 804 and the fourth contact portion (on the side of the circuit board 80 opposite to the second contact portion 804), the width P1 of the second contact portion 804 and the width P1 of the fourth contact portion are only slightly greater than or equal to the width P2 of the first contact portion 802 and the width P2 of the third contact portion (on the side of the circuit board 80 opposite to the first contact portion 802). It is notified that the first connecting portion 60A and the second connecting portion 60B may be a flat cable and a flexible flat cable, respectively, or the connecting portion 60 may include a single row of first connecting portion 60A or a single row of second connecting portion 60B. As illustrated in FIG. 24B, when only the first connecting portion 60A is provided and welded to the second contact portion 804 on the upper side of the circuit board 80, it is not necessary to provide the second connecting portion 60B. When only the second connecting portion 60B is welded to the fourth contact portion 808 on the lower side of the circuit board 80, it is not necessary to provide the first connecting portion 60A. Compared with FIG. 24A where the second contact portion and the fourth contact portion are on the opposite side of the circuit board 80, the second contact portion 804 includes the second contact portion and the fourth contact portion arranged on the same side, as illustrated in FIG. 24A. So the circuit board 80 needs to include more second contact portions 804. The width P3 of one side of the second contact portion 804 is greater than the width P4 of one side of the first contact portion 802. Meanwhile, the number of the first connecting portions 60A in FIG. 24B may be the sum of the number of the first connecting portions 60A and the number of the second connecting portions 60B in FIG. 24B.

Figure 25:
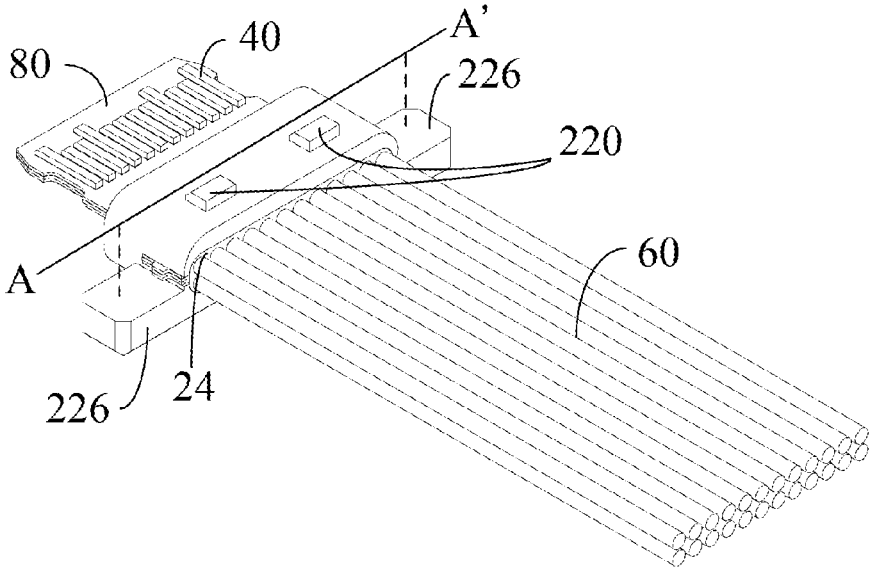
FIG. 25 is a diagram of the cable structure with the shell removed.
Figure 26:
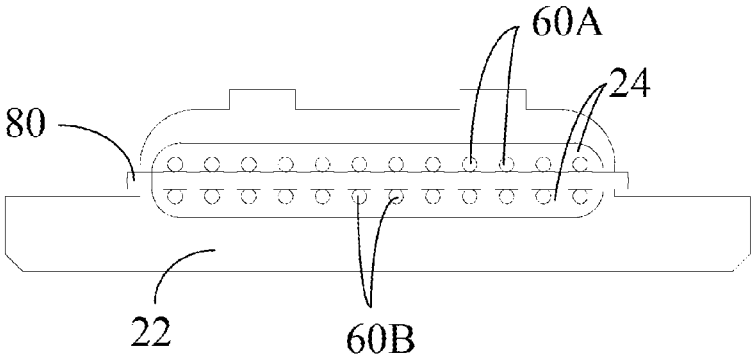
FIG. 26 is a cross-sectional diagram taken along line A-A' in FIG. 25.

Please refer to FIG. 25 and FIG. 26. FIG. 25 is a diagram of the cable structure with the shell 20 removed. FIG. 26 is a cross-sectional diagram taken along line A-A' in FIG. 25. Further, ultraviolet (UV) glue 24 is proposed by the fourth embodiment and the cover 22 is wrapped around the circuit board 80. The connecting portion 60 is connected to the upper and lower layers of the circuit board 80, and the UV glue 24 fills the space between the connecting portion 60 and the cover 22. Moreover, the UV glue 24 fills the gap between the connecting portion 60 and the cover 22 originally. So the connecting portion 60 can be well fixed without shaking.

Figure 27:
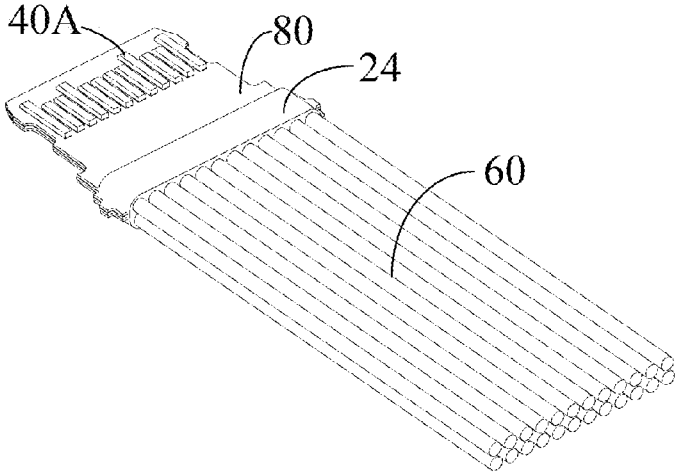
FIG. 27 is a diagram of the UV glue, the terminal, the connecting portion, and the circuit board.
Figure 28:
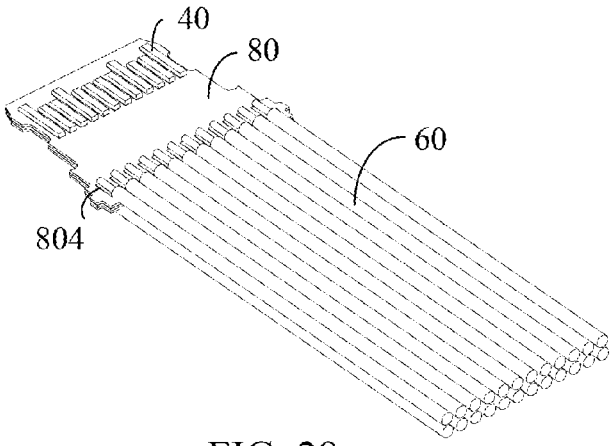
FIG. 28 is a diagram of the terminal, the connecting portion, and the circuit board.

FIG. 27 is a diagram of the UV glue 24, the terminal 40, the connecting portion 60, and the circuit board 80. The UV glue 24 is arranged at one terminal of the circuit board 80 near the connecting portion 60. As FIG. 28 illustrates, the UV glue 24 is removed. FIG. 28 is a diagram of the terminal 40, the connecting portion 60, and the circuit board 80. The terminal 40 is electrically connected to the first contact portion 802. The connecting portion 60 is electrically connected to the second contact portion 804. The UV glue 24 also fills the space where the connecting portion 60 is electrically connected to the second contact portion 804. In this way, the possibility of loose welding between the connecting portion 60 and the circuit board 80 greatly lowers.

Figure 29:
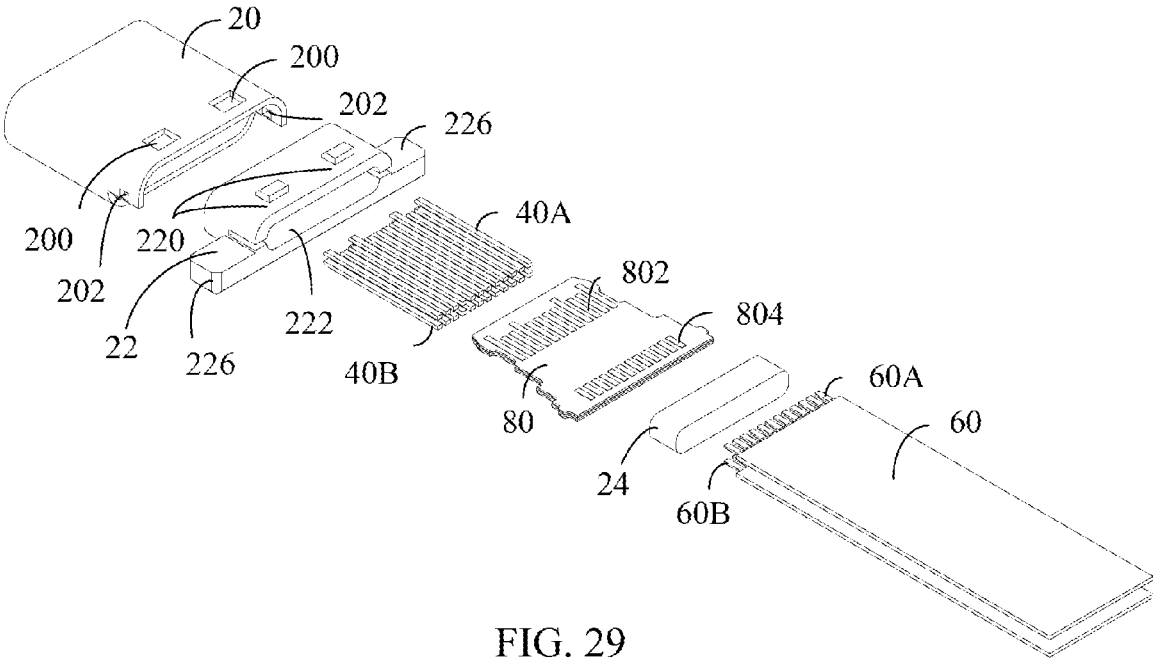
FIG. 29 is an exploded diagram of a connector according to a fifth embodiment of the present disclosure.

FIG. 29 is an exploded diagram of a connector 10 according to a fifth embodiment of the present disclosure. The fifth embodiment is a variation of the fourth embodiment, and the diagram of the connector 10 proposed by the fifth embodiment is referred to FIG. 22. The connector 10 in the fifth embodiment is similar to the connector 10 in the fourth embodiment in appearance, and a connecting portion 60 can be a cable or a flexible flat cable as well. Line (in this embodiment, a flexible flat cable is taken as an example). Different from the fourth embodiment, a terminal 40 is connected to a first contact portion 802 and a second contact portion 804 both in the fifth embodiment so that the terminal 40 can be directly electrically connected to a connecting portion 60.

Figure 30:
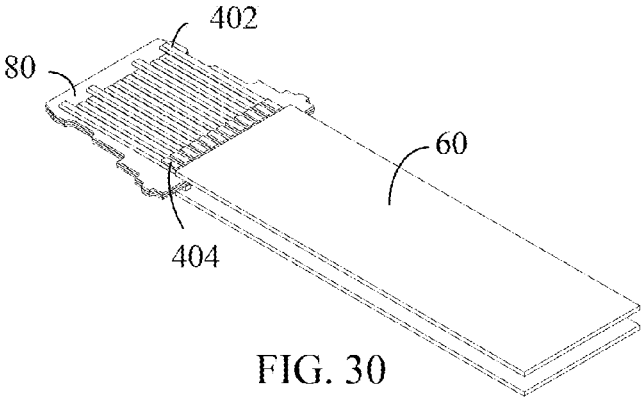
FIG. 30 illustrates a diagram of the terminal, the connecting portion, and a circuit board.

Please refer to FIG. 30 as well. FIG. 30 illustrates a diagram of the terminal 40, the connecting portion 60, and a circuit board 80. Two terminals of the terminal 40 are a first terminal 402 and a second terminal 404. The first terminal 402 and the second terminal 404 are electrically connected to the first contact portion 802 and the second contact portion 804, respectively. The connecting portion 60 is electrically connected to the second terminal 404. The connecting portion 60 is arranged over the terminal 40 in the present disclosure. The terminal 40 is electrically connected to the second contact portion 804 directly. The connecting portion 60 is electrically connected to the terminal 40 directly. Such a connection that the second contact portion 804 is electrically connected to the terminal 40 stabilizes the connection of the second contact portion 804 and the terminal 40 better. It is notified that any structure in which the terminal 40 is electrically connected to the second contact portion 804 and the connecting portion 60 is electrically connected to the second contact portion 804 is also within the scope of the present disclosure.

Figure 31:
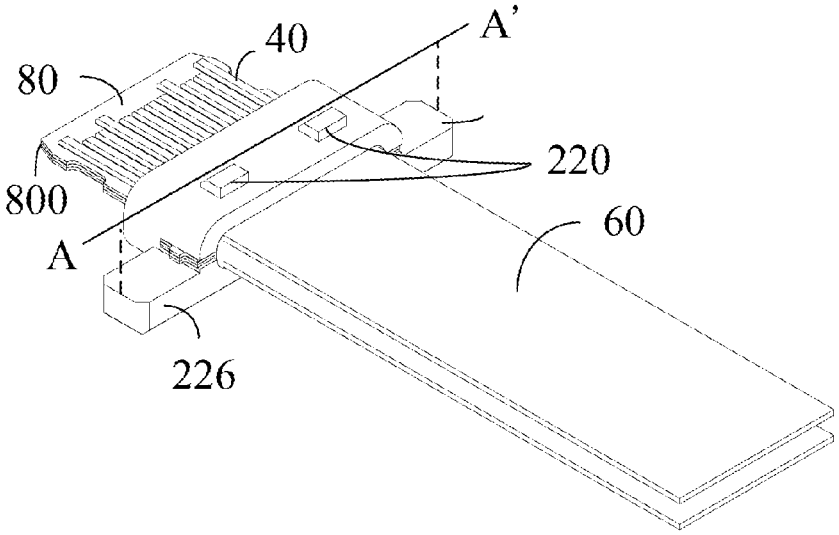
FIG. 31 is a diagram of the connector with the cover and the UV glue covered and arranged around the circuit board according to the fifth embodiment.
Figure 32:
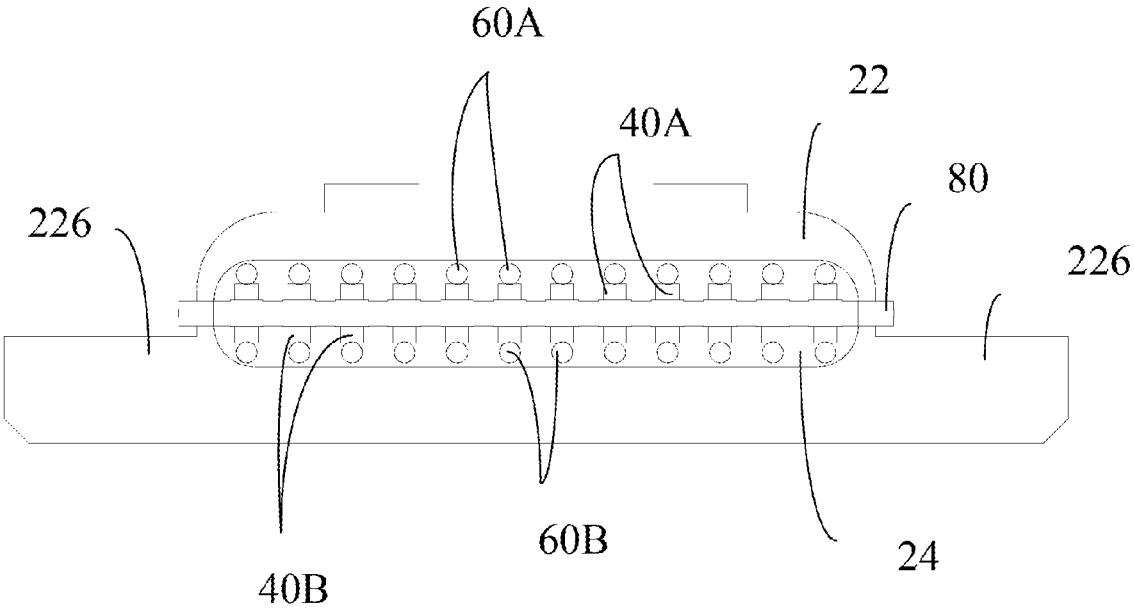
FIG. 32 illustrates a cross-sectional diagram of cutting the cover along a line A-A'.

FIG. 31 is a diagram of the connector 10 with the cover 22 and the UV glue 24 covered and arranged around the circuit board 80 according to the fifth embodiment. Although the UV glue 24 cannot be seen, it is clear that FIG. 31 for the fifth embodiment is different from FIG. 25 for the fourth embodiment. The terminal 40 in the present embodiment extends to the UV glue 24 and is connected to the connecting portion 60 covered with the UV glue. So the UV glue 24 not only fix the connecting area between the connecting portion 60 and the second contact portion but also the connecting area between the terminal 40 and the connecting portion 60. The UV glue 24 in the present embodiment is filled in the cover 22, the connecting portion 60, and the circuit board 80 as in the fourth embodiment. Please refer to FIG. 32 illustrating a cross-sectional diagram of cutting the cover 22 along a line A-A'. The UV glue 24 is filled between the cover 22 and the circuit board 80. The terminal 40 and the connecting portion 60 are arranged on both sides of the circuit board 80. The connecting portion 60 is in direct contact with the terminal 40. The connecting portion 60 is connected to the circuit board 80 indirect through the terminal 40.

Figure 33:
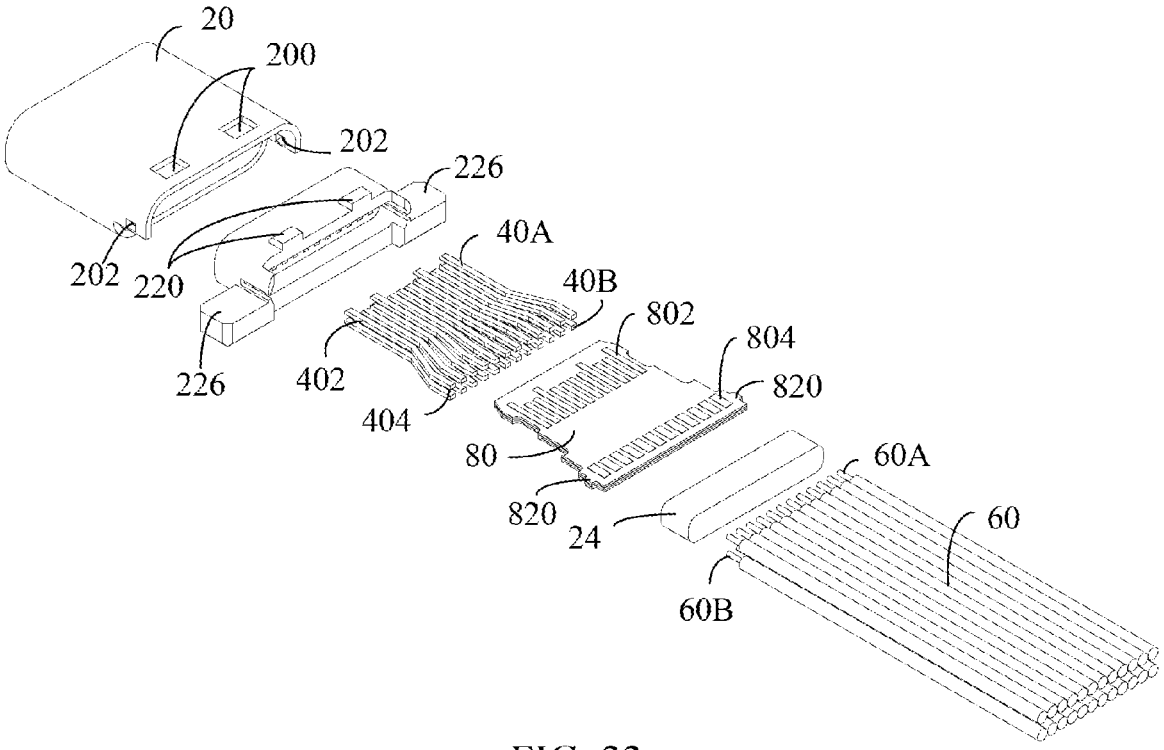
FIG. 33 illustrates a diagram of a connector according to a sixth embodiment of the present disclosure.

Please refer to FIG. 33 illustrating a diagram of a connector according to a sixth embodiment of the present disclosure. The sixth embodiment is a variation of the fifth embodiment. The difference between the fifth embodiment and the sixth embodiment lies in the shape of a terminal 40. The terminal 40 includes two terminals, a first terminal 402 and a second terminal 404. The shape of the terminal 40 in the present disclosure is similar to the terminal connecting portion 50 in the third embodiment. The first terminal 402 is shaped as a bar. The second terminals 404 are shaped as a trapezoid. The second terminals 404 of the terminal connecting portion close to the center are straight lines. The second terminals 404 of the terminal connecting portion outwards are curved to both sides, and the more outwardly the curved portion is, a greater amount of amplitude it has. The second terminal 404 is connected to the connecting portion 60. The second terminals are shaped as a trapezoid like the shape of the second terminals 504 in the third embodiment. So the total width of the second terminals 404 is greater than the first terminals 402.

Figure 34:
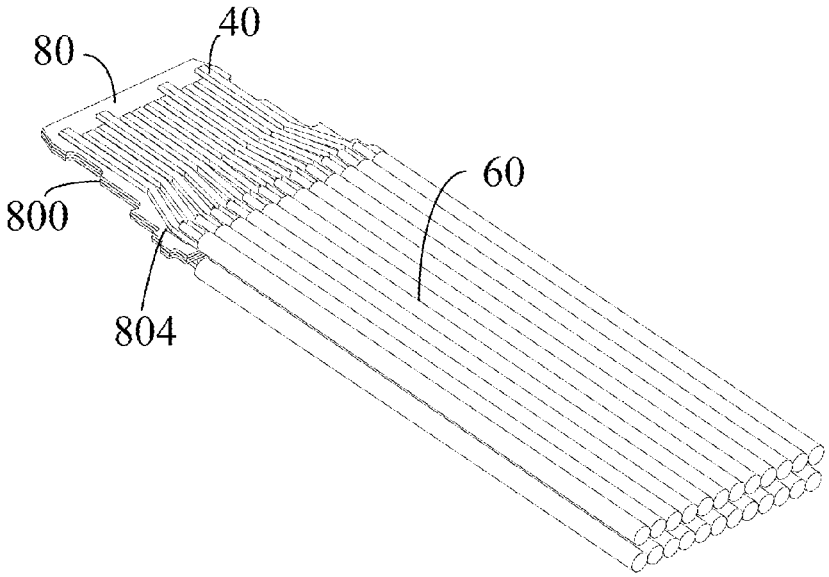
FIG. 34 illustrates a diagram of the terminal, the connecting portion, and the circuit board.
Figure 35:
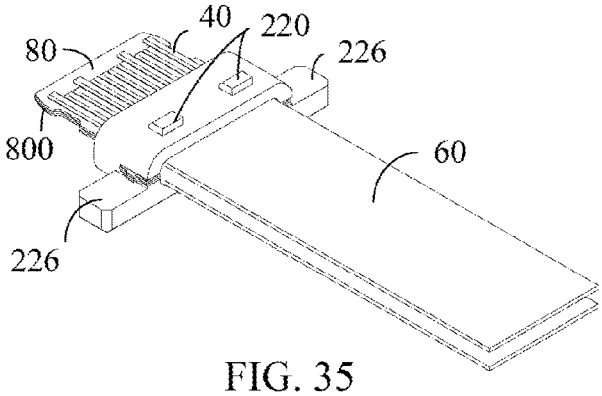
FIG. 35 is a diagram of the connector with a cove and ultraviolet (UV) glue.

Please refer to FIG. 34 illustrating a diagram of the terminal 40, the connecting portion 60, and the circuit board 80. The terminal 40 is arranged on the circuit board 80 and electrically connected to the first contact portion 802 and the second contact portion 804. The connecting portion 60 is arranged on the second terminal 404 and electrically connected to the terminal 40. FIG. 35 is a diagram of the connector 10 with a cover 22 and ultraviolet (UV) glue 24. After the cover 22 and the UV glue 24 are added, the difference between the sixth embodiment and the fifth embodiment is rare obvious. However, the width of the connecting portion 60 and the first terminal 402 of the terminal 40 are different between the sixth embodiment is different so the sixth embodiment can apply to a case where the width of a slot for a connecting port of an electronic device is different from the width of a slot for a connecting port of an external device.

Other configurations of the fourth to sixth embodiments are similar to those of the first to third embodiments. Please refer to the exploded diagrams like FIG. 24, FIG. 29, and FIG. 33 for the fourth to sixth embodiments. The first contact portion 802 and the second contact portion 804 arranged on the circuit board 80 are all formed by a plurality of metal coatings. Although not illustrated in the exploded diagram, the back of the circuit board 80 also includes the third contact portion 806 and the fourth contact portion 808. The third contact portion 806 and the fourth contact portion 808 are also formed by a plurality of metal coatings as well. Two protrusions 220 are arranged on the cover 22. The protrusions 220 conform to two holes 200 on the shell 20. The protrusions 220 can be caught on the holes 200. The shell 20 further includes two lateral holes 202 respectively arranged at two sides of the shell 20. The locking portion 820 of the circuit board 80 is arranged correspondingly to the lateral holes 202 so that the locking portion 820 is caught in the lateral holes 202 and that the circuit board 80 is fixed onto the shell 20. The ground layer 800 on the circuit board 80 is electrically connected to the shell 20 so that the ground layer 800 provides better shielding and isolates signal interference between the upper and lower layers of the circuit. Further, conductive glue can apply to the area where the locking portion 820 is connected to the lateral hole 202 so that the locking portion 820 and the lateral hole 202 are electrically connected, and the friction and shaking between the locking portion 820 and the lateral hole 202 are reduced. The UV glue 24 can be utilize to insulate the conductive glue or the shell 20 to prevent the connecting portion 60 from being electrically connected to a ground potential.

The connecting portion 60 proposed by the fourth, the fifth, and the sixth embodiments may be a cable or a flexible flat cable, or may be applied to a connector with a plurality of cables. Owing to the design of the cover 22 of the fourth to sixth embodiments, a user of the present disclosure holds the cover 22 of the connector 10 which is exposed outside the shell 20 when he/she plugs or unplugs the connector 10 to avoid directly pulling the cable, the flexible flat cable, or other cable structure of the connecting portion 60 to prevent short circuit or welding loss.

Figure 36:
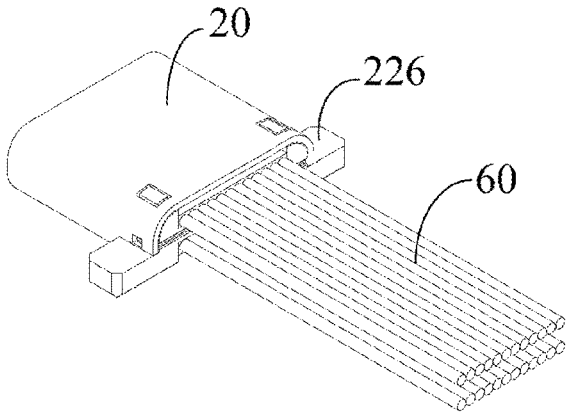
FIG. 36 illustrates a diagram of a connector according to a seventh embodiment of the present disclosure.

Please refer to FIG. 36 illustrating a diagram of a connector 10 according to a seventh embodiment of the present disclosure. The seventh embodiment is a variation of the fourth embodiment and applies to the structure of a connecting portion 60 which may be a cable or a flexible flat cable. The biggest difference between the fourth embodiment and the seventh embodiment is that no terminal 40 is adopted in the seventh embodiment, and the connecting portion 60 extends to be connected to a circuit board 80. A front terminal of the connecting portion 60 is a cable or a wire of a flexible flat cable. In addition, the front terminal of the connecting portion 60 replaces the terminal 40 to be connected to the circuit board 80. The front terminal of the connecting portion 60 is connected to the connecting port slot of the external device through the connector of the present disclosure.

Figure 37:
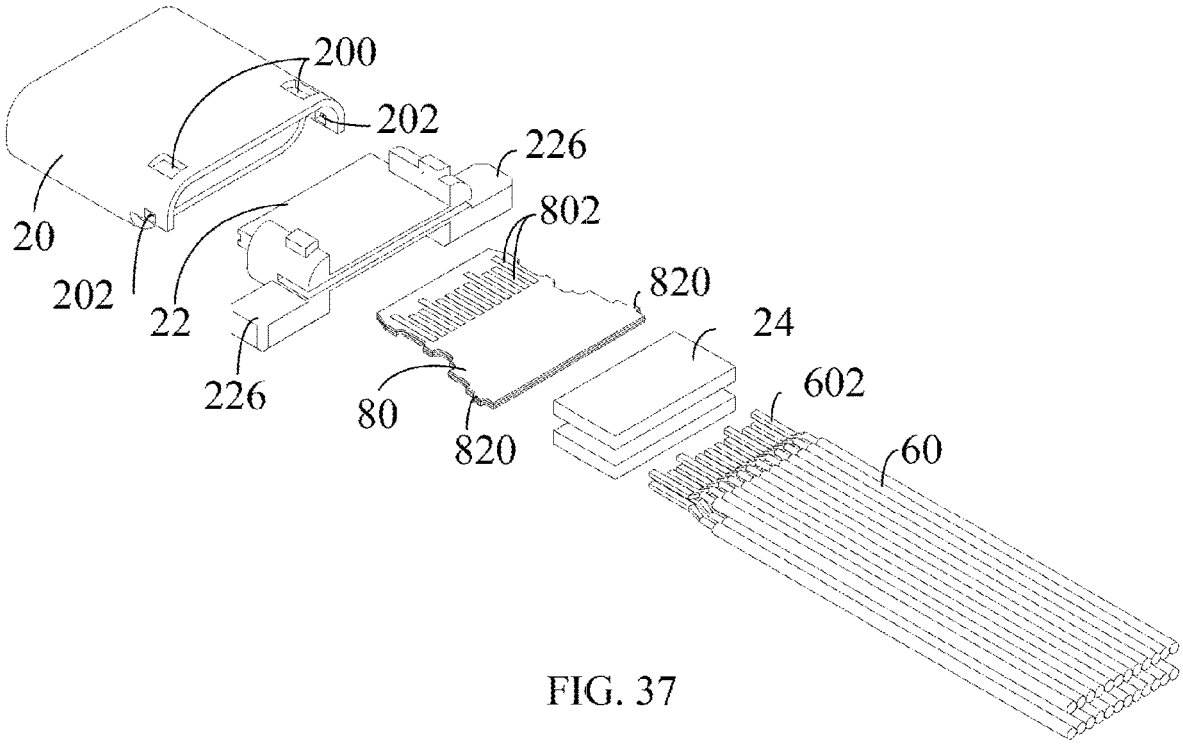
FIG. 37 is an exploded diagram of the connector according to the seventh embodiment of the present disclosure.
Figure 38A:
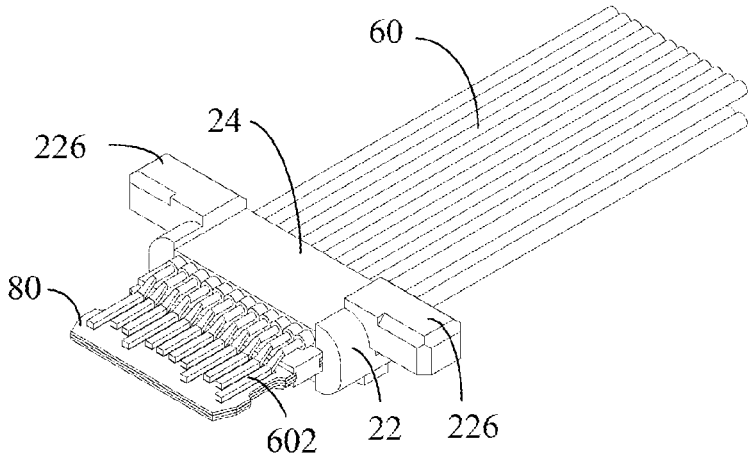
FIG. 38A illustrates a schematic diagram of the structure of the cover, the UV glue, the connecting portion, the front terminal of the connecting portion and the first contact portion.
Figure 38B:
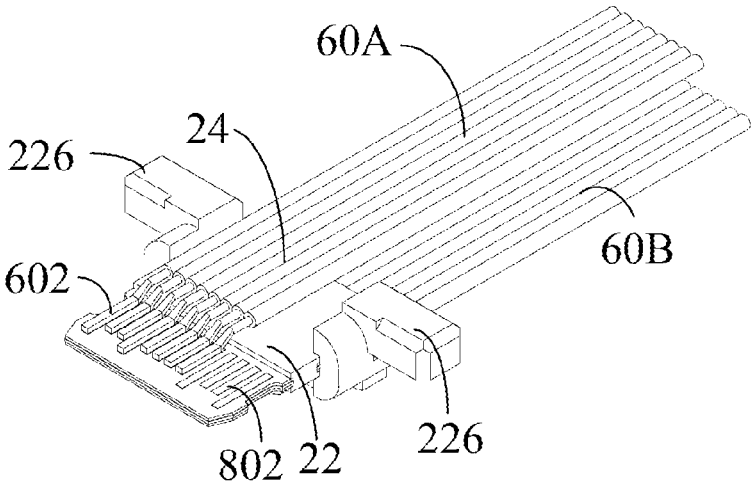
FIG. 38B illustrates a structure of the cover, the front terminal of the connecting portion and the first contact portion.

FIG. 37 is an exploded diagram of the connector 10 according to the seventh embodiment of the present disclosure. The connector 10 includes a shell 20, a cover 22, ultraviolet (UV) glue 24, a connecting portion 60, and a circuit board 80. In this embodiment, only the first contact portion 802 is on the circuit board, and the front terminal 602 of the connecting portion 60 extends and is electrically connected to the first contact portion 802. FIG. 38A is a schematic diagram of the structure of the cover 22, the UV glue 24, the connecting portion 60, the front terminal 602 of the connecting portion and the first contact portion 802. FIG. 38B illustrates a structure of the cover 22, the front terminal of the connecting portion 602 and the first contact portion 802. Unlike the fourth to sixth embodiments, the connecting portion 60 of the present embodiment is not arranged between the cover and the circuit board, instead, on the cover 22, and extends over the cover 22 so that the front terminal 602 of the connecting portion can be electrically connected to the first contact portion 802, as illustrated in FIG. 38A. The UV glue 24 is arranged between the connecting portion 60 and the shell 20 and fills the gap between the connecting portion 60 and the shell 20 to lessen the sway of the connecting portion 60 to reduce the possibility of contact failure or short circuit.

The cover 22 and a front terminal of the connecting portion 602 can refer to FIG. 38B. FIG. 38B illustrates the connector 10 with the UV glue removed and a plurality of connecting portions 60 removed to elaborate the structure of the front terminal 602 and the cover 22 of the connector 10 in FIG. 38B. As FIG. 38B illustrates, the connecting portion 60 extends above the cover 22, and the front terminal 602 of the connecting portion is electrically connected to the first contact portion 802 on the circuit board 80.

The seventh embodiment also includes two upper and lower layers. The back surface of the circuit board 80 also includes a third contact portion 806. The connecting portion 60 also includes a first connecting portion 60A and a second connecting portion 60B. The first connecting portion 60A and the second connecting portion 60B are on upper and lower layers, respectively. The front terminal of the first connecting portion 60A is electrically connected to the first contact portion 802. The front terminal 602B of the second connecting portion 60B is electrically connected to the third contact portion 806. The configurations of the first connecting portion 60A and the second connecting portion 60B are similar to those of the fourth to sixth embodiments, and therefore will not be described again.

Figure 39:
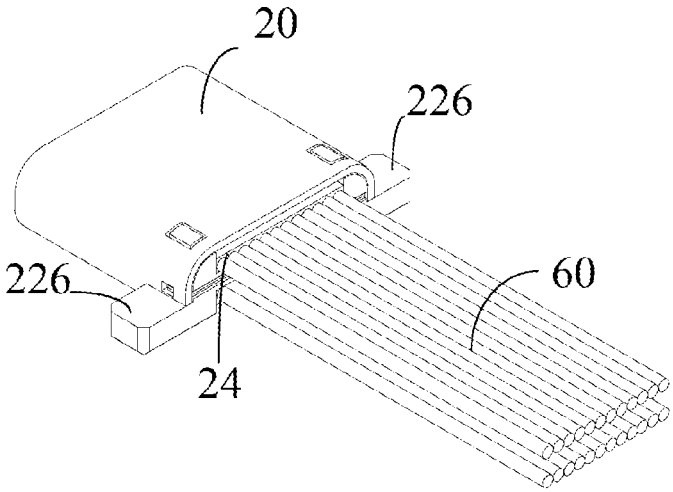
FIG. 39 is a diagram of a connector according to an eighth embodiment of the present disclosure.

FIG. 39 is a diagram of a connector according to an eighth embodiment of the present disclosure. This embodiment is a variation of the seventh embodiment and applies to a structure in which a connecting portion 60 is a cable or a flexible flat cable as well. The present embodiment is characterized in that the structure of a cover 22 is different from the cover 22 in the seventh embodiment in order to match the change of the connecting portion 60. For details, please refer to FIG. 40.

Figure 40:
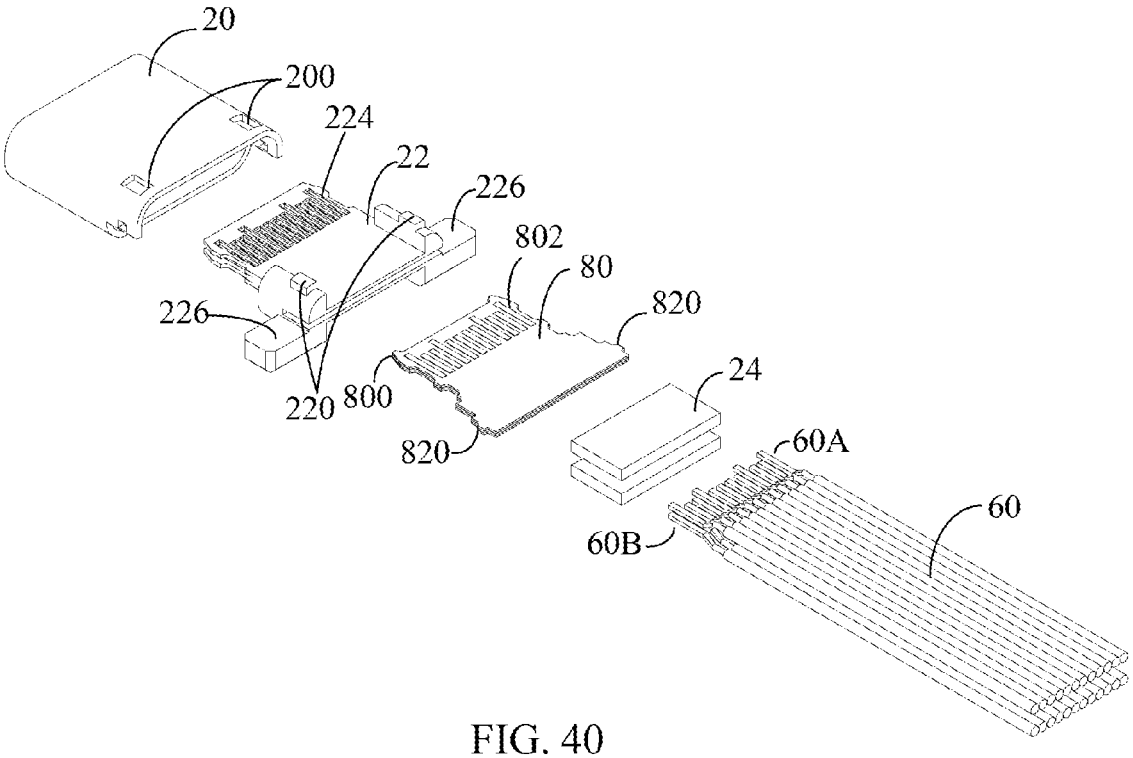
FIG. 40 is an exploded diagram of a connector according to the eighth embodiment of the present disclosure.
Figure 41:
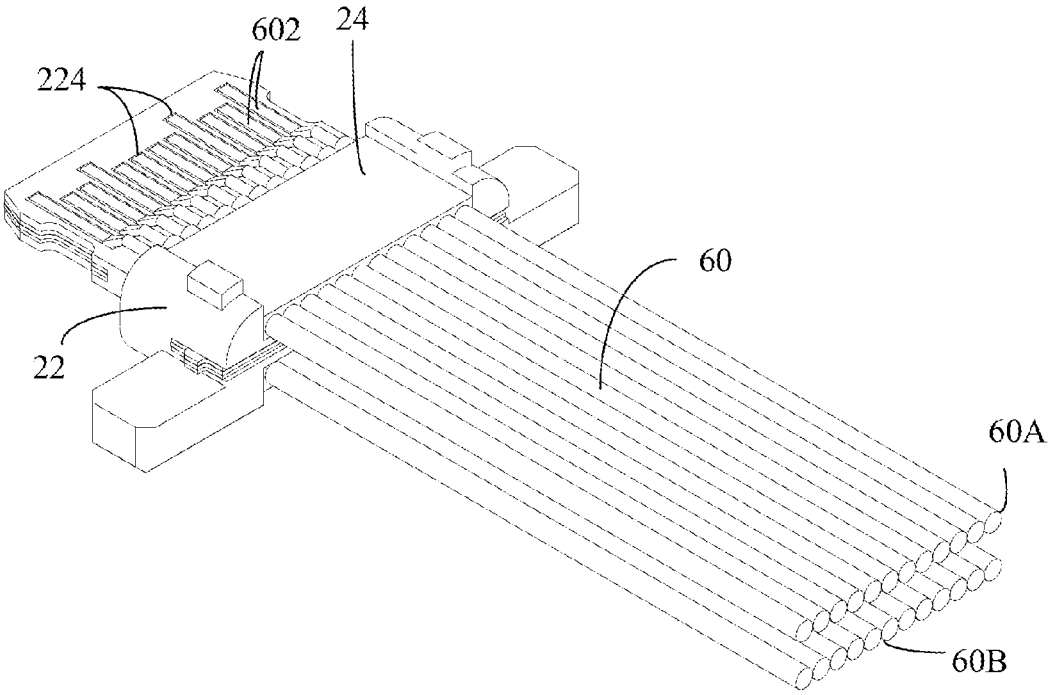
FIG. 41 is a schematic diagram of the eighth embodiment after removing the shell.

FIG. 40 is an exploded diagram of a connector 10 according to the eighth embodiment of the present disclosure. The connector 10 includes a shell 20, a cover 22, ultraviolet (UV) glue 24, a connecting portion 60, and a circuit board 80. In this embodiment, only a first contact portion 802 is on the circuit board, and the front terminal 602 of the connecting portion 60 extends forward and is electrically connected to the first contact portion 802. The connecting portion 60 is arranged on the cover 22 as well. The connecting portion 60 extends forward and is electrically connected to the first contact portion 802. The UV glue fills the gap between the connecting portion 60 and the shell 20 as well. The eighth embodiment is characterized in that the cover 22 has an outer groove 224 corresponding to the front terminal 602 of the connecting portion 60. As illustrated in FIG. 41, FIG. 41 is a schematic diagram of the eighth embodiment after removing the shell 20. Each of the wires at the front terminal of the connecting portion 60 is arranged in each of the outer grooves 224 and is electrically connected to the first contact portion 802 on the circuit board 80 through the outer groove 224.

Figure 42:
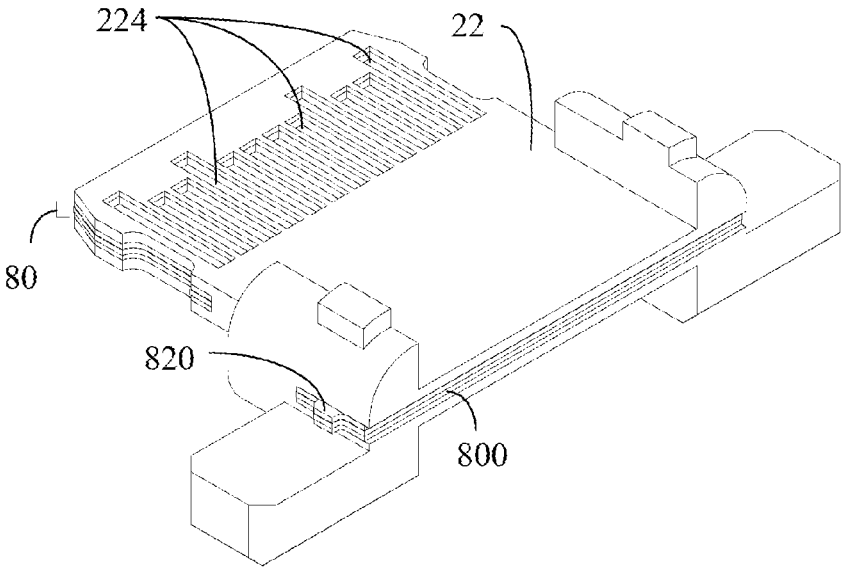
FIG. 42 is an enlarged diagram of the cover and the circuit board.
Figure 43:
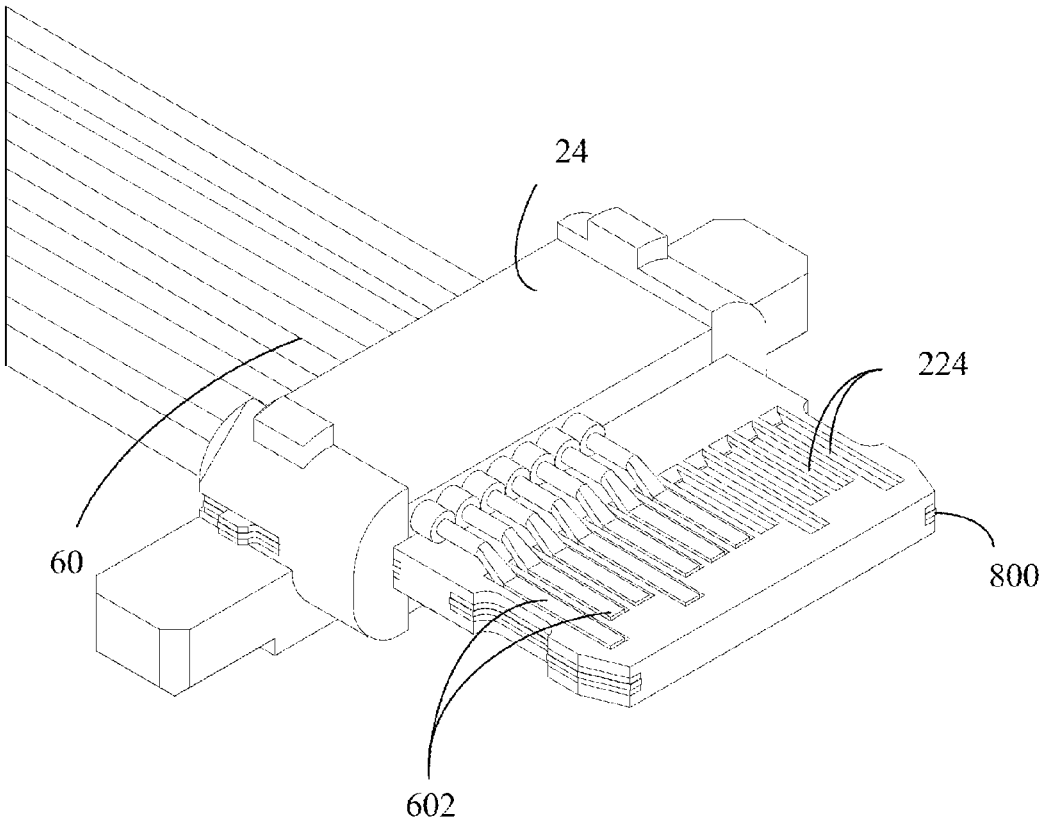
FIG. 43 depicts a configuration of the cover, the UV glue, and the connecting portion.

FIG. 42 is an enlarged diagram of the cover 22 and the circuit board 80. The cover 22 has an outer groove 224 corresponding to the front terminal 602 of the connecting portion 60, and the circuit board 80 is arranged inside the cover 22. A ground layer 800 is arranged on the circuit board 80 as well. The configurations of the cover 22, the UV glue 24, and the connecting portion 60 are illustrated in FIG. 43. After the partial connecting portion 60 is removed, the opposing structure of the outer groove 224 on the cover 22 and the connecting portion 60 can be clearly seen. The outer groove 224 is configured such that each wire of the connecting portion 60 is fixed in the groove, so that the connecting portion 60 is not easily shaken and that the welding between the connecting portion 60 and the first contact portion 802 is not easily broken off. The stability of the connector 10 is ensured.

The seventh and eighth embodiments are the same as the first to sixth embodiments. Two protrusions 220 are arranged on the cover 22, as illustrated in FIG. 27 and FIG. 40. The protrusions 220 conform to the two holes 200 in the shell 20, and the protrusions 220 can be caught on the holes 200. The shell 20 further includes two lateral holes 202 and the lateral holes 202 are arranged at two sides of the shell 20, respectively. The locking portion 820 of the circuit board 80 is at a position corresponding to the lateral holes 202, so that the locking portion 820 is caught in the lateral holes 202, so that the circuit board 80 is fixed to the shell 20. The ground layer 800 on the circuit board 80 is electrically connected to the shell 20 so that the ground layer 800 provides better shielding and isolates signal interference between the upper and lower layers of the circuit. Further, conductive glue can apply to the area where the locking portion 820 is connected to the lateral hole 202 so that the locking portion 820 and the lateral hole 202 are electrically connected, and the friction and shaking between the locking portion 820 and the lateral hole 202 are reduced. Meanwhile, the UV glue 24 can be utilized as well. It is utilized to insulate the conductive glue or the shell 20 to prevent the connecting portion 60 from being electrically connected to the ground potential.

The connector of the present disclosure can apply to different embodiments according to a variety of port slots at the two terminals. Compared with the connector of the related art that various shells, terminals, circuit boards, and connecting portions are required to match various connecting requirements, the present disclosure can lower the manufacturing costs of producing different parts for connectors. For example, in the first to third embodiments, the size of the circuit board 80 and the shell 20 may be the same, and only the distribution of the metal coating of the second contact portion on the circuit board 80 and the shape of the connecting portion are changed so that the first embodiment and the third embodiment apply to different slots of electronic devices, respectively. Another example is the seventh and eighth embodiments, the terminal can save the manufacturing costs and reduce the number of metal coatings on the circuit board 80.

In addition, in the connector proposed by the present disclosure, the ground layer 800 of the circuit board 80 is electrically connected to the shell 20 so it is possible to enhance the shielding effect. The area where the circuit board 80 contacts the shell 20 may be coated with conductive glue as well to enhance the stability of its electrical connection and to improve the stability of the area where the circuit board 80 and the shell 20 are connected. The connector 10 proposed by the present disclosure further includes the UV glue 24 so that the connecting portion is fixed in the shell 20 or cover 22 without shaking and falling off or causing poor contact at welding areas.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A connector, comprising:

a shell, configured to protect the connector and to be plugged into a connecting port slot;

a plurality of terminal connecting portions, electrically connected to the connecting port slot, the plurality of terminal connecting portions having first terminals of an upper row and second terminals of a lower row corresponding to the first terminals;

a circuit board between the first terminals and the second terminals, comprising:

a first contact portion, electrically coupled to the first terminals;

a second contact portion, electrically coupled to the second terminals; and a ground layer, between the first terminals and the second terminals; and a cover, fixed to the shell, the cover arranged between the circuit board and the shell to fix the circuit board in the shell.

2. The connector of claim 1, wherein the first terminals are shaped as a trapezoid and curved outward.

3. The connector of claim 1, wherein the cover comprises an inner groove so that the terminal connecting portion penetrates the inner groove.

4. The connector of claim 1, wherein a ground layer is arranged between the circuit board and electrically connected to the shell.

5. The connector of claim 4, wherein the connector further comprises conductive glue and distributed between the ground layer of the circuit board and the shell to make the circuit board be electrically connected to the shell.

6. The connector of claim 1, wherein the connector comprises ultraviolet (UV) glue.

7. The connector of claim 1, wherein the shell comprises a lateral hole, the circuit board comprises a locking portion, the lateral hole is configured to lock the locking portion and the locking portion locks the lateral hole.

8. The connector of claim 1, wherein the shell comprises a hole, the cover comprises a protrusion, the protrusion of the cover locks the hole of the shell and the hole of the shell locks the cover.

9. A connector, comprising:

a shell, configured to protect the connector and to be plugged into a connecting port slot;

connecting portions, one terminal of each of the connecting portions being connected to an electronic device, the other terminal of each of the connecting portions extending to the shell and being connected to the connecting port slot, the connecting portions having first terminals of an upper row and second terminals of a lower row corresponding to the first terminals, an orientation of the first terminals being the same as an orientation of the second terminals;

a circuit board, comprising a first contact portion and a ground layer between the first terminals and the second terminals, the connecting portions contacting the circuit board; and a cover, surrounding the circuit board.

10. The connector of claim 9, wherein a ground layer is arranged between the circuit board and electrically connected to the shell.

11. The connector of claim 9, wherein a plurality of inner grooves are arranged on the cover, the plurality of inner grooves match the number and shape of the connecting portions to fix the connecting portions on the plurality of inner grooves, part of the connecting portions penetrate the cover to be electrically connected to the first contact portion.

12. The connector of claim 9, wherein the connector comprises ultraviolet (UV) glue, the UV glue fills the space between the connecting portions and the shell.

13. The connector of claim 9, wherein the shell comprises a lateral hole, the circuit board comprises a locking portion, the lateral hole is configured to lock the locking portion and the locking portion locks the lateral hole.

14. The connector of claim 9, wherein the shell comprises a hole, the cover comprises a protrusion, the protrusion of the cover locks the hole of the shell and the hole of the shell locks the cover.

* * * * *